US007322845B2

(12) United States Patent
Regnier et al.

(10) Patent No.: US 7,322,845 B2
(45) Date of Patent: Jan. 29, 2008

(54) CONNECTOR DELATCHING MECHANISM WITH RETURN ACTION

(75) Inventors: Kent E. Regnier, Lombard, IL (US); Brian Keith Lloyd, Maumelle, AR (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/242,200

(22) Filed: Oct. 3, 2005

(65) Prior Publication Data

US 2006/0134961 A1 Jun. 22, 2006

Related U.S. Application Data

(60) Provisional application No. 60/636,833, filed on Dec. 16, 2004.

(51) Int. Cl.
*H01R 13/627* (2006.01)

(52) U.S. Cl. ..... 439/352; 439/483

(58) Field of Classification Search ..... 438/352, 438/484, 483; 439/352, 484, 483
See application file for complete search history.

(56) References Cited

U.S. PATENT DOCUMENTS 5,199,897 A * 4/1993 Hashiguchi ..... 439/357
5,344,194 A 9/1994 Hatagashi et al.
5,516,305 A * 5/1996 Haluska ..... 439/484
5,564,939 A 10/1996 Maitani et al.
5,613,870 A * 3/1997 Traver, Jr. ..... 439/352
5,634,809 A 6/1997 Hirai
5,741,150 A 4/1998 Stinson et al.
5,915,987 A 6/1999 Reed et al.
6,146,179 A * 11/2000 Denny et al. ..... 439/352
6,234,828 B1 5/2001 Kuo
6,371,787 B1 4/2002 Branch et al.
6,382,995 B1 5/2002 Bricaud et al.
6,589,066 B1 7/2003 Wu
6,592,391 B1 7/2003 Wu
6,641,425 B1 11/2003 Wu
6,648,665 B1 11/2003 Wu
6,648,666 B1 11/2003 Wu
6,659,755 B1 12/2003 Wu
6,702,602 B2 * 3/2004 Wu ..... 439/352
6,702,603 B2 * 3/2004 Wu ..... 439/352

(Continued)

OTHER PUBLICATIONS

International Search Report in International Application No. PCT/US2005/045844, May 8, 2006.

*Primary Examiner*—Tulsidas C. Patel
*Assistant Examiner*—Harshad C Patel
(74) *Attorney, Agent, or Firm*—Thomas D. Paulius

(57) ABSTRACT

A shielded housing that provides a shield to a circuit board connector of the SFP-style includes a conductive body that encompasses the connector. The housing has an opening that defines an entrance of the housing through which an opposing mating connector may be inserted. The housing also includes a pair of engagement tabs that are bent inwardly of the housing at an angle thereto and these tabs engage openings formed in a shell of a plug connector that mates with the SFP-style connector. The tabs rest in the openings and may be released by way of latching mechanism that is part of the plug connector. This mechanism includes a handle and two arms that extend lengthwise. The arms end in cam portions that contact and lift the engagement ends out of the plug connector shell openings to unlatch the plug connector from the SFP-style connector.

25 Claims, 23 Drawing Sheets

U.S. PATENT DOCUMENTS 6,722,912 B2 4/2004 Wu
6,749,448 B2 6/2004 Bright et al.
6,808,410 B1 * 10/2004 Lee ..... 439/484
6,824,416 B2 11/2004 DiMascio et al.
2003/0236017 A1 * 12/2003 Waddell et al. ..... 439/352
2004/0077226 A1 4/2004 Murr et al.
2006/0019525 A1 1/2006 Lloyd et al.
2006/0134985 A1 6/2006 Reed et al.

* cited by examiner

FIG. 17
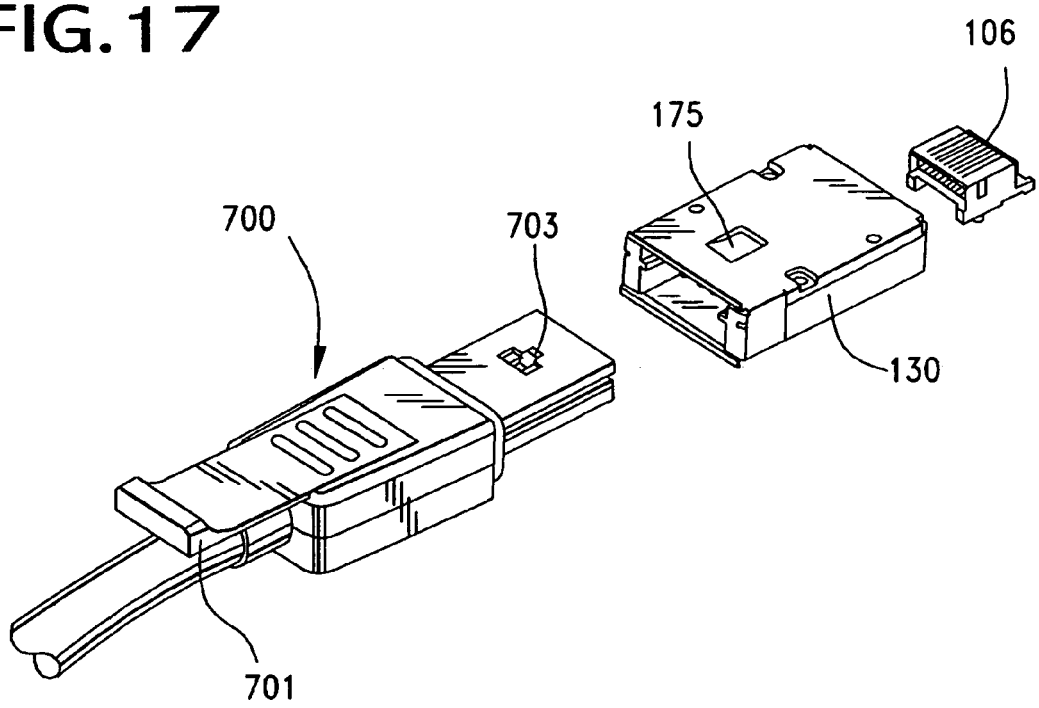
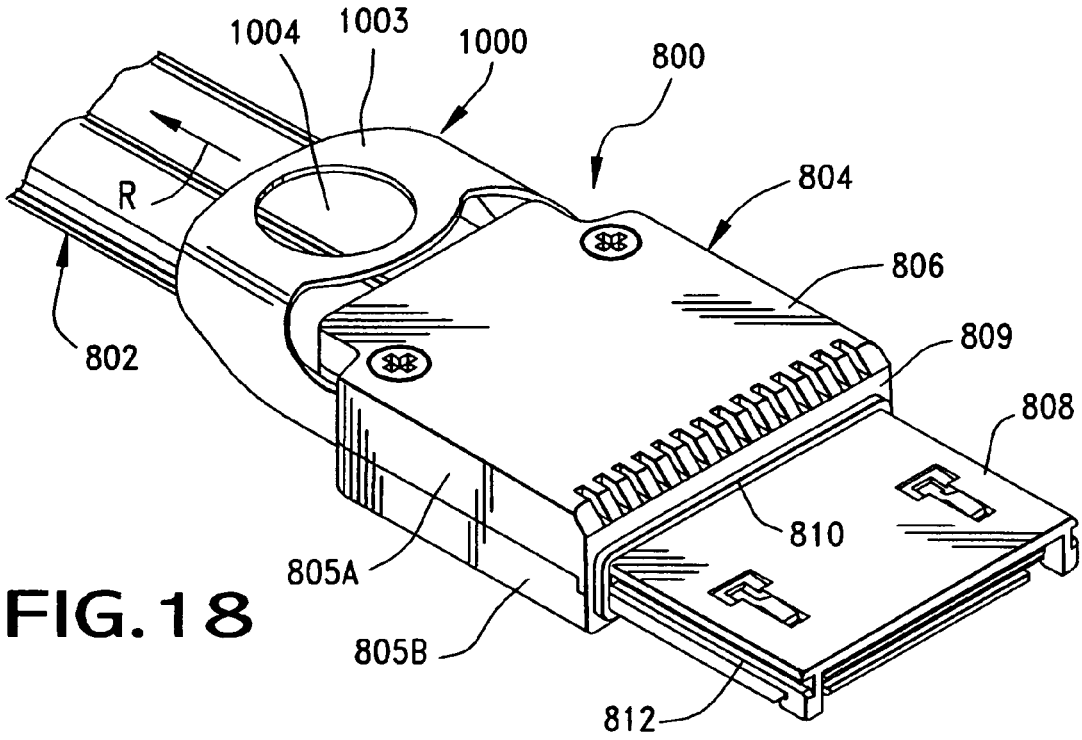
FIG. 18

FIG.21
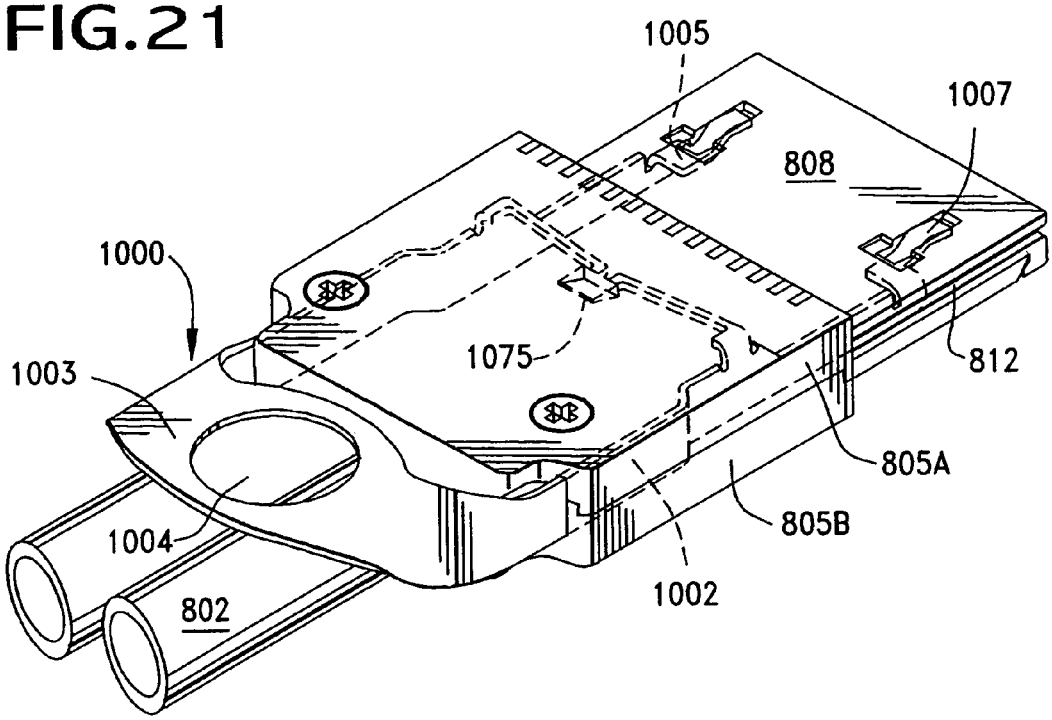
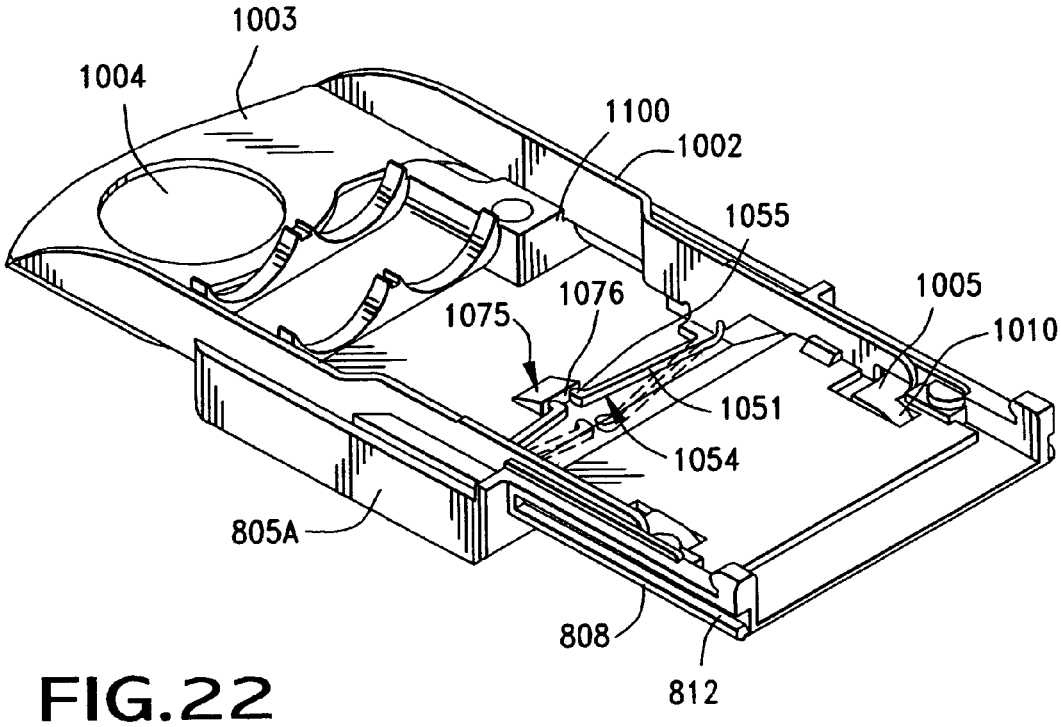
FIG.22

CONNECTOR DELATCHING MECHANISM WITH RETURN ACTION

REFERENCE TO RELATED APPLICATIONS

This application claims priority from prior U.S. Provisional Patent Application No. 60/636,833, filed Dec. 16, 2004.

BACKGROUND OF THE INVENTION

The present invention is directed generally to small size connectors and to shielded housings that enclose such connectors, and more particularly toward plug connectors that are received within such housings and which mate with such small size connectors.

High speed data transfer systems require electrical connectors in which the electrical impedance can be controlled in order to maintain the required data transfer rate of the electrical system. Low profile connectors, such as those used in SFP (Small Form Factor Pluggable) applications are desired in electronic devices in which space is a premium and thus it is difficult to guide the opposing mating plug connectors into contact with such connectors. The plug connector typically includes a circuit card that has a projecting edge that is received within a card opening in the SFP connector. Shielding cages are typically utilized with such connectors to control the emission of electromagnetic interference. These cages often serve as a secondary housing for the connector in that they will substantially enclose the connectors. The small size of the SFP style connectors makes it difficult for ensuring that the opposing mating connectors mate properly with the SFP connectors.

It is further difficult with these small sizes to ensure that the shield housing is of a size sufficiently large to permit solder reflow processing of the connector without bridging occurring between the connector contacts and the shield housing.

The small size of the circuit board connectors makes it further difficult to provide an opposing mating connector of the plug type that secures engages the shield housing surrounding the circuit board connector.

It is desirable given the small size of the these circuit board connectors, that mating plug connectors include a means to engage, or latch with the circuit board connectors and also that the plug connector have a means for delatching themselves from the circuit board connectors. Such a delatching means should have incorporated therewith some means for returning the delatching mechanism of the plug connector to an original (or latched) condition.

The present invention is therefore directed to an improved plug connector for use with SFP connectors of reduced size that overcomes the aforementioned shortcomings and which provides for engaging the plug connector to a shielded housing associated with and encompassing the SFP connector, as well as a means for delatching or disengaging the plug connector from the SFP connector.

SUMMARY OF THE INVENTION

Accordingly, it is a general object of the present invention to provide a surface mount style connector for mounting on a circuit board, the connector having a plurality of conductive terminals supported therein in spaced apart order, and a conductive outer shielding cage or housing that encompasses the connector and controls electromagnetic interference emission therefrom.

A further object of the present invention is to provide a shield housing for use with a right angle, low profile surface mount connector for use in high speed applications in which the shield housing has one or more guides formed therewith which extend from the shield housing and which are received within a corresponding opposing recess formed in the opposing mating connector.

A still further object of the present invention is to provide a shielded housing for use with a surface mount connector that guides an opposing connector into place with the connector and which may be manufactured inexpensively and having a reduced size so as not to enlarge the size of the overall connector system it is used with.

Another object of the present invention is to provide a shielded housing for use with SFP-style connectors in which the shielded housing includes a diecast hollow base and a sheet metal cover member, the cover member having an entrance portion associated that engages a forward portion of the base, the base including two sidewalls spaced apart from each other and extending rearwardly from the entrance portion, each of the sidewalls including a projecting guide rail formed therein, the two guide rails being received within corresponding recesses formed on the opposing mating connector and collectively cooperating to guide the opposing mating connector into engagement with the SFP connector enclosed by the shield housing and the cover member further including one or more engagement tabs that extend away from the cover in a direction to engage portions of the plug connector, when the plug connector is inserted in the guide frame.

Still yet another object of the present invention is to provide a shielded housing with a connector guide system incorporated therein and which has a shape that permits multiple housings to be spaced close to each other.

A further object of the present invention is to provide a mechanism for delatching the plug connector from its mated condition with any of the aforementioned shielded housings, the plug connector having a housing and an actuator moveably mounted thereon, the actuator including a handle portion and at least one actuating portion that is disposed on the free end of a latch arm that extends lengthwise through the plug connector, the actuating portion being moveable between first and second operative positions which correspond to respective latched and unlatched conditions of the plug connector.

Still an additional object of the present invention is to provide a delatching or ejector system for a reduced size plug connector, the plug connector having a housing, a circuit card extending forwardly out of the housing, the plug connector mating with a small connector that is mounted on a circuit board and which is enclosed by a covering structure having one or more engagement tabs that engage the plug connector when it is mated with the connector, and a delatching assembly at least partially disposed within the housing, the latching assembly having a rear handle portion and two arms that extend forwardly from the handle portion through the connector housing, the arms terminating in free ends, and each of the free ends including a cam portion that is aligned to selectively contact a corresponding engagement tab disposed on an opposing shielded housing to move the engagement tab out of engagement with the plug connector housing so that the plug connector may be disengaged and easily removed from the shielded housing.

Yet a further object of the present invention is to provide a delatching mechanism as mentioned above in which the plug connector includes a conductive outer shell that at least partially encompasses an internal circuit card, the shell having a pair of T-shaped openings disposed therein, the actuator arm portions being aligned with these openings and at least being partially received therein, the shielded housing engagement tabs depending downwardly at an angle toward an interior space of the shielded housing, the T-shaped openings and the cam portions of the actuator arms being aligned with the engagement tabs, whereby movement of the actuator arms urges the cam portions into contact with the engagement tabs and thereby moves them out of engagement with the plug connector housing.

Yet another object of the present invention is to provide a delatching mechanism of the type described above for a plug connector, where the delatching mechanism further includes a means for returning the actuator to an initial position, the return means including a pair of spring arms that extend at an angle to the arms of the actuator, the spring arms being aligned with a shoulder portion of the plug connector housing, the housing shoulder portion defining a reaction surface against which the return arms may be biased so as to apply a spring force to the actuator and return it to an initial position after it has been withdrawn.

The present invention accomplishes the aforementioned and other objects by the way of its novel and unique structure.

In one embodiment of the invention, a conductive metal housing is formed such as by die casting and the housing includes an interior hollow portion. This hollow portion fits over a SFP-style connector that is mounted to a circuit board. The housing has an opening formed at a forward portion thereof and the opening defines an entrance to the housing. One or more projections, or engagement tabs, are formed with the housing and these projections extend into the recess and into the opening of the housing to provide one or more guide members that must be received within a corresponding recess or groove formed in the exterior of the opposing mating connector.

In another embodiment of the present invention, the housing may be formed of multiple pieces. In this embodiment, a base is provided that includes at least a pair of spaced-apart side walls, each of which has a guide projection formed on an interior surface thereof. These two guides must be received within corresponding opposing grooves formed in an opposing mating connector in order for the opposing mating connector to fit into and enter the housing to mate with the SFP style connector. As such they define a keying system that ensures correct mating of the two connectors, even when the installation of the opposing mating connector is blind. The housing may further include a sheet metal cover with a rectangular, hollow entrance portion that is formed so as to mate with the forward end of the base.

In another embodiment of the invention, the shield housing is entirely formed from a sheet metal and is constructed by way of a stamping and forming process. One or more tabs are stamped out of the sheet metal and bent downwardly so as to enter the interior of the housing. These tabs must be received within a corresponding opposing recess or groove on the mating connector in order for the connector to be properly received within the shield housing.

In yet another embodiment of the invention, the receptacle housing may be formed as a one-piece or two-piece die-cast housing with means for attaching it to a circuit board by way of screws or the like. The housing preferably includes a series of posts that have mounting holes drilled therein which receive mounting screws, and the posts are arranged in a staggered fashion on the sidewalls of the housing so that the posts on the left side of a housing may fit into grooves formed on the right side of an adjacent housing. This staggering permits the housings to be placed in close spacings with each other on circuit boards.

In the latching mechanism of the present invention, the plug connector housing is provided with recesses that receive the engagement tabs of the shielded housing when the plug connector is inserted therein to mate with the SFP-style circuit board connector enclosed in the shielded housing. A delatching assembly has a handle portion that is disposed at a rear end of the plug connector housing, and two arms that extend forwardly therefrom in a spaced-apart fashion through the plug connector housing. The two latch arms are capable of lengthwise linear movement in this embodiment and move forwardly and rearwardly within the housing of the plug connector. Two free ends of the actuator arms extend forwardly from the plug connector housing into the area that is partially bounded by the conductive metal shell disposed at the forward end of the plug connector.

The two free ends of the actuator arms each preferably include a cam portion that has an upwardly angled cam surface disposed thereon and which may take the form of a solid cam block or which may be formed as a step in the free end. Openings that preferably include T-shapes are formed in the plug connector housing and the cam portions are aligned with these openings and partially reside within portions of the openings. When the actuator handle is pulled, the actuator arm free ends and cam portions are moved between first and second operative positions. In one of the two positions, the cam portions are in a rest position and in the other of the two positions, the cam portions are urged against engagement members of the shielded housing.

The shielded housing includes one or more engagement members that are preferably formed as tabs which may be stamped from the shielded housing. These engagement tabs are bent inwardly at an angle and are angled downwardly into the shielded housing interior and extend at a downward angle toward the rear of the shielded housing. These engagement members are aligned with the T-shaped openings of the plug connector and the cam portions of the latching mechanism. The engagement tabs extend into the T-shaped openings when the plug connector is fully engaged with the shielded housing and so prevent the plug connector from working free from engagement with the circuit board connector. The cam portions are moveable, in a linear fashion, within the T-shaped openings, and their angled surfaces may be moved against the engagement tabs, lifting them up and out of engagement with the plug connector housing to unlatch the plug connector from the shielded housing so that it may be removed.

The actuator arms may have incorporated therewith, a return mechanism that returns the actuator arms back to an initial position. This mechanism, in one embodiment of the invention, utilizes two return springs that are formed as spring arms which extend transversely to the lengthwise extent of the actuator arms. The free ends of these return spring arms contact a reaction surface that takes the form of a block that is disposed on an inner surface of the plug connector housing. These return spring arms provide a biasing force to the actuator and forces it to return to an initial position after it has been moved to delatch the plug connector from the shielded housing.

These and other objects, features and advantages of the present invention will be clearly understood through a consideration of the following detailed description.

BRIEF DESCRIPTION OF THE DRAWINGS

In the course of this detailed description, reference will be frequently made to the attached drawings in which:

FIG. 17 is a perspective view of another embodiment of the present invention;

FIG. 18 is a perspective view of a plug connector with another embodiment of a detaching mechanism constructed in accordance with the principles of the present invention;

FIG. 21 is the same view as FIG. 18, but at a different angle and illustrating, in phantom, the actuating mechanism of FIG. 20 in place within the plug connector;

FIG. 22 is a perspective view of the interior of the top half of the plug connector of FIG. 18, and illustrating it in contact with the reaction block of the plug connector;

DETAILED DESCRIPTION OF THE PREFERRED EMBODIMENTS

Figure 1:
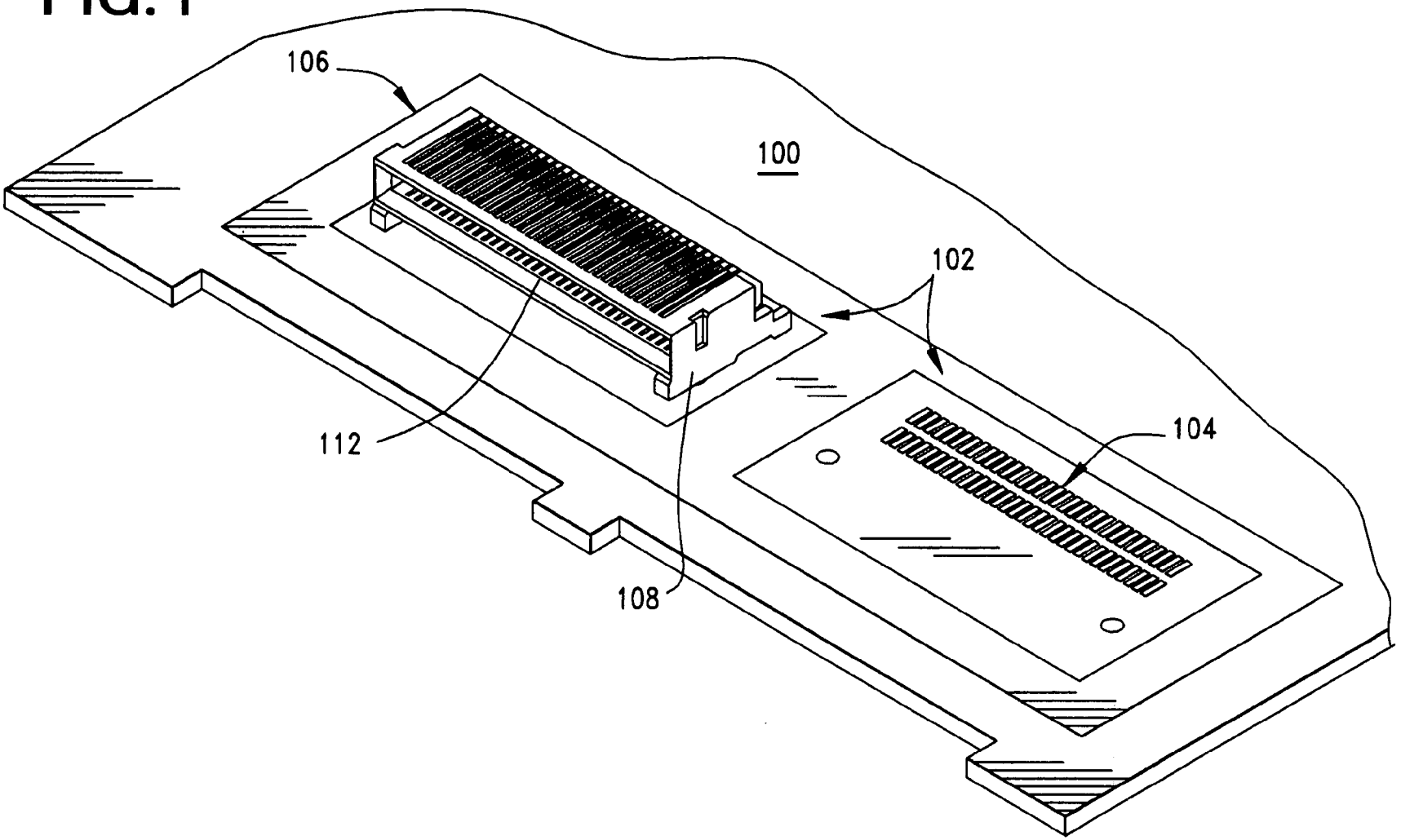
FIG. 1 is a perspective view of a circuit board with two arrangements of conductive contact pads disposed thereon and with a SFP-style connector mounted to one of the two contact pad arrangements.
Figure 6:
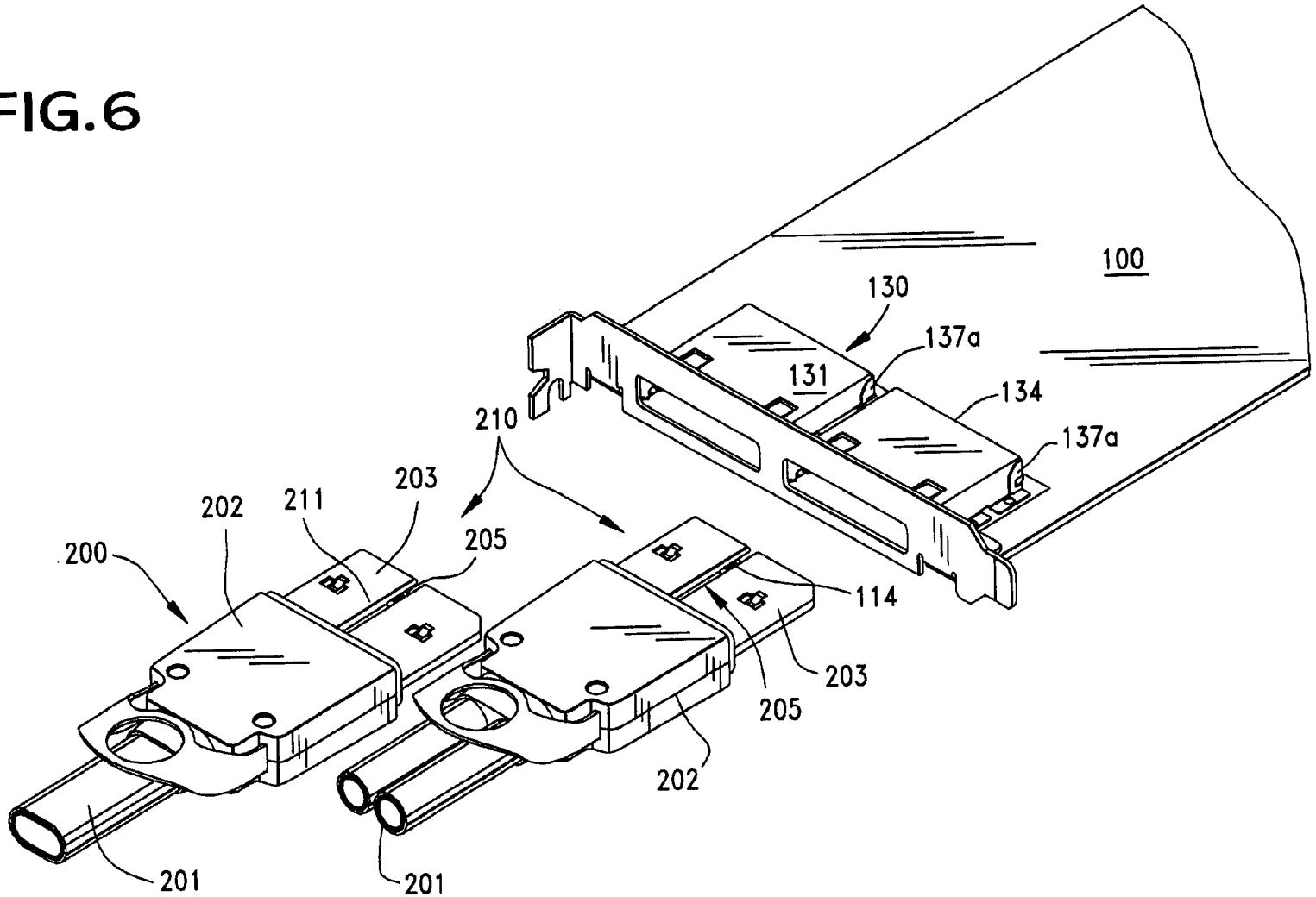
FIG. 6 is the same view as FIG. 5, but with a mounting bracket in place across the two shield housings and with two opposing mating plug connectors shown removed from engagement with the SFP-style connectors.

FIG. 1 illustrates the environment in which the shield housings of the invention are used. The environment shown includes a planar circuit board 100, with two designated connector areas 102 defined therein, each including a plurality of conductive contact pads 104. One such area has a SFP-style connector 106 in place. This connector 106 has an insulative housing 108 and supports a plurality of conductive terminals 110. Such a connector 106 typically includes a slot 112 that is intended to receive the edge of a circuit card 114 that is mounted to an opposing mating plug-style connector 200. (FIG. 6.)

Figure 2:
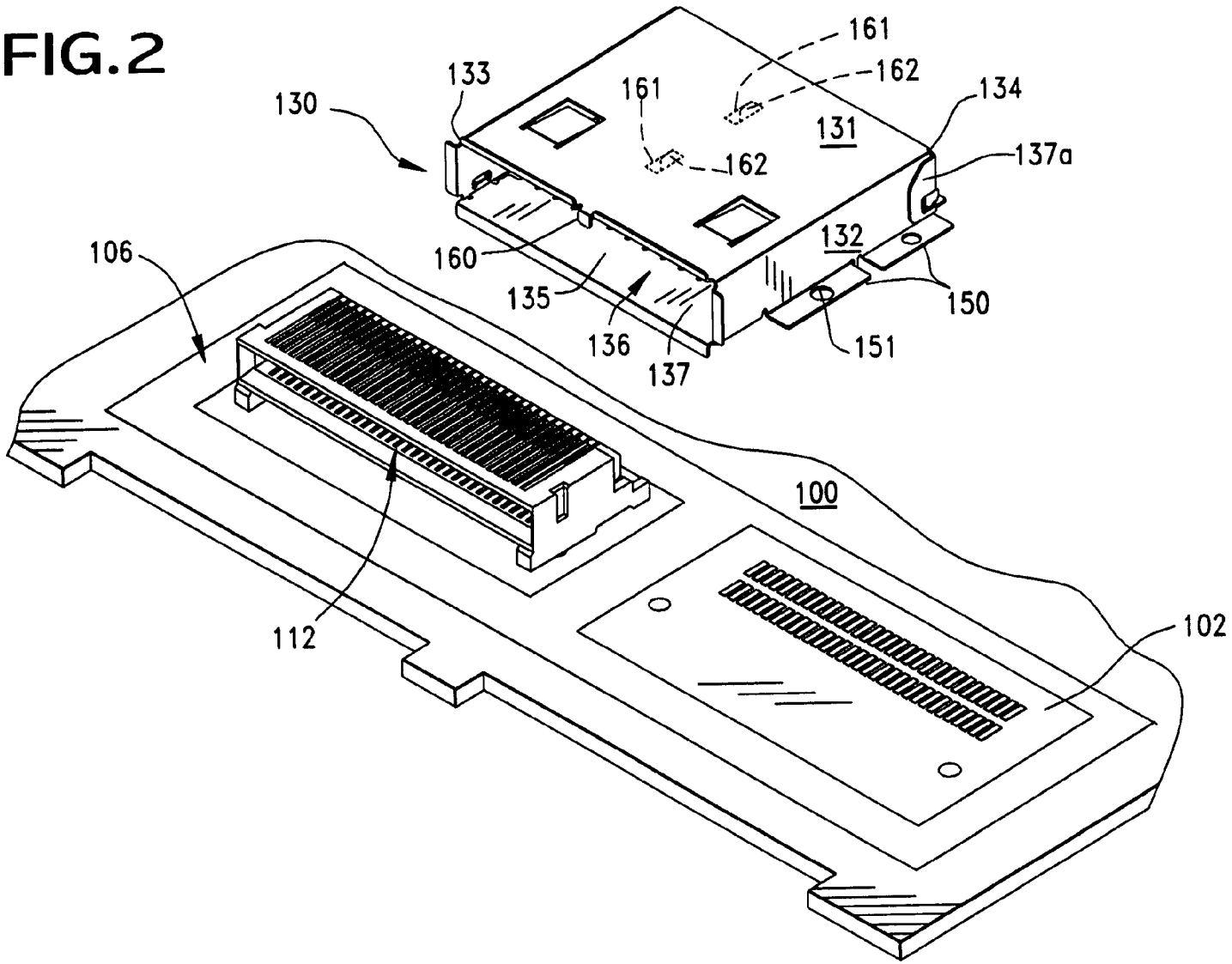
FIG. 2 is the same view as FIG. 1, but with a shield housing constructed in accordance with the principles of the present invention shown removed away from and above the circuit board.

FIG. 2 illustrates one embodiment of a shielded housing 130 constructed in accordance with the principles of the present invention. As illustrated, the shielded housing 130[,] is preferably formed from a sheet metal blank through a suitable process, such as a stamping and forming process. In this regard, it includes a top wall 131, two side walls 132, 133, a back wall 134 and a bottom wall 135. These walls are all combined to collectively define an opening 136 that leads to a hollow interior cavity 137. The back wall 134 may include a pair of flange ends 137, which are bent over upon each of the side walls 132, 133 to secure the back wall to the housing and to seal off the rear of the internal cavity 137.

The bottom wall 135 is preferably formed as only a partial bottom wall which does not extend completely back to the rear wall 134. Rather, it has a depth that is less than the depth of the entire housing to define an internal cavity 139 on the bottom of the housing 130 which may be placed over the SFP-style connector 106 with which it is used. The bottom wall 135 may have an engagement flange 140 formed at an end thereof, which is bent at an angle and which engages a corresponding opposing engagement tab 141 formed on side wall 133 to secure a framework for the entrance of the shield housing 130

Figure 3:
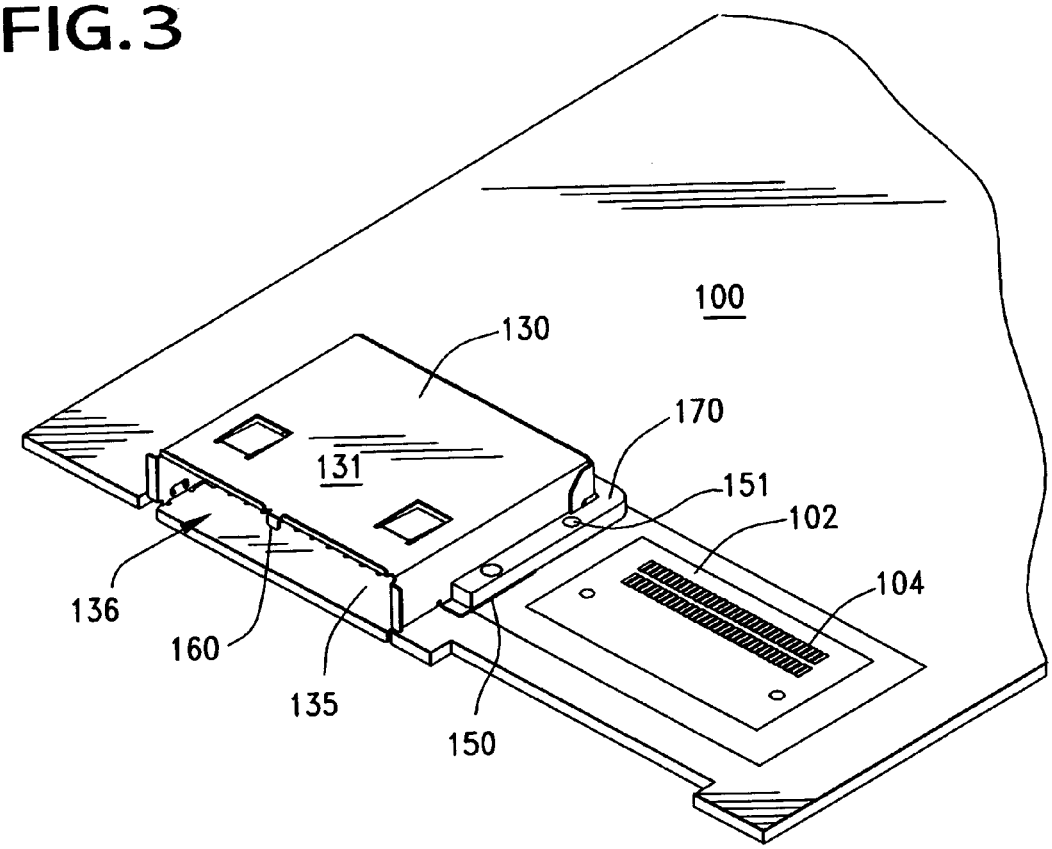
FIG. 3 is a same view as FIG. 2, but with the shield housing shown in place upon the circuit board and encompassing the SFP-style connector.
Figure 4:
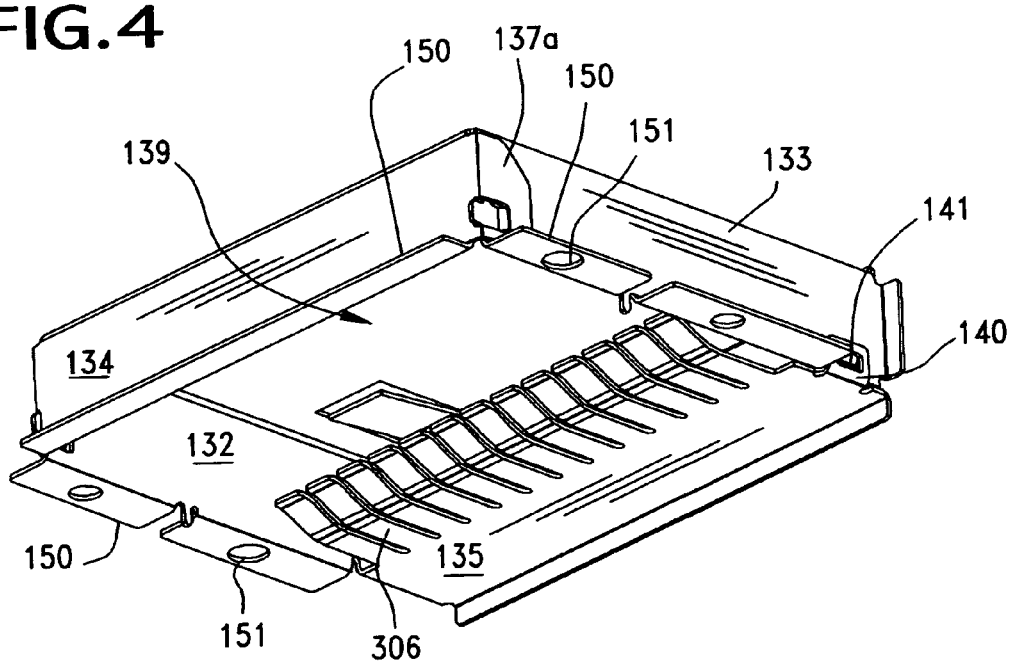
FIG. 4 is a perspective view, taken from underneath, of the shield housing of FIGS. 2 & 3.
Figure 5:
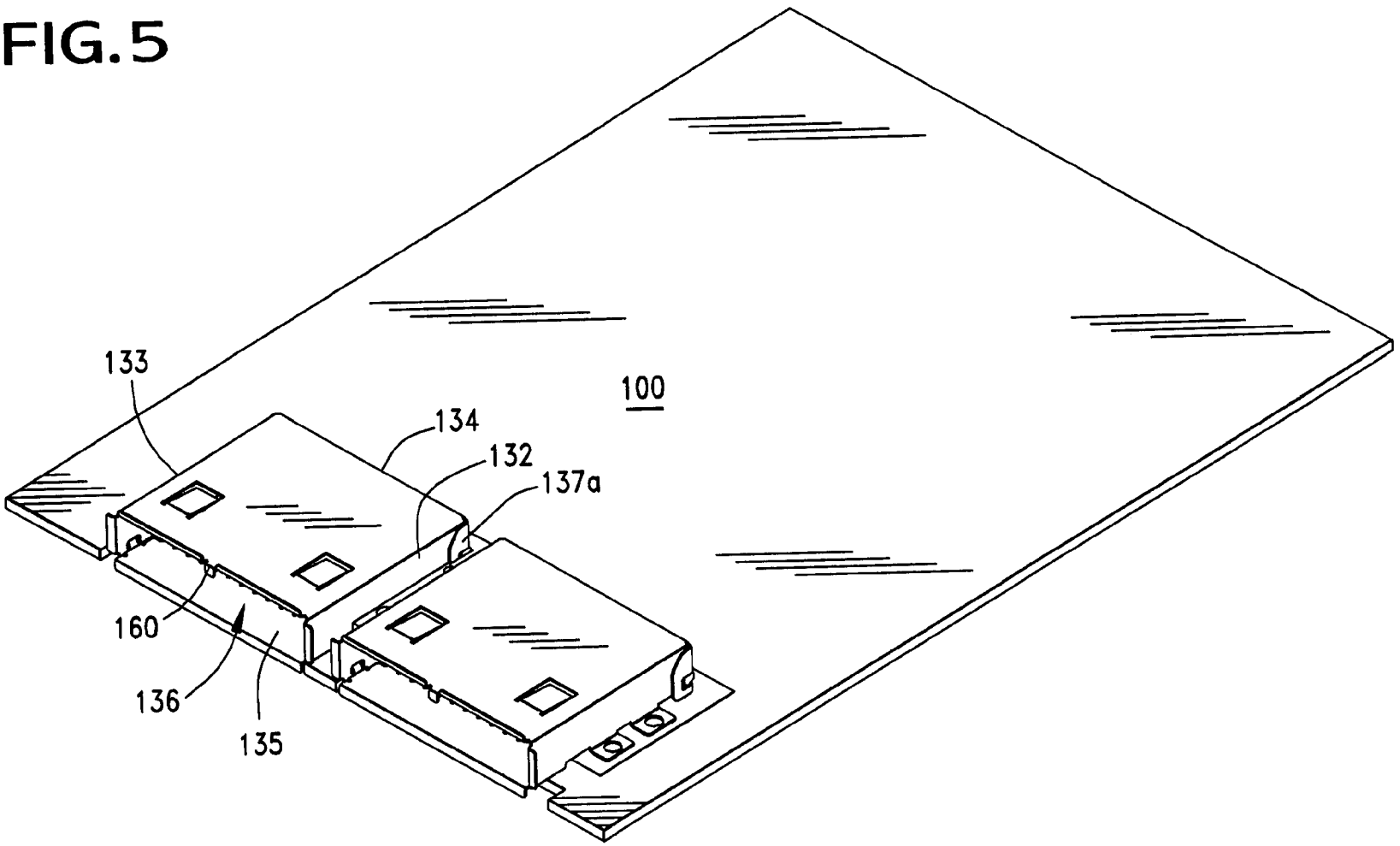
FIG. 5 is the same view as FIG. 3, but with a second shield housing mounted adjacent to the first shield housing.

As shown best in FIG. 4, the housing 130 may also include a series of flanges 150 formed along the side walls 132, 133 or back wall 134 that are bent at an angle in order to provide a flat mounting surface that opposes the top surface of the circuit board 100. These flanges 150 may include openings 151 that receive screws or bolts (not shown) for attachment to the circuit board or they may be flat for soldering to the board 100. A U-shaped EMI gasket 170 may be placed over these flanges 150 as shown in FIG. 3 to prevent EMI leakage from the sides and rear of the housing 103.

Turning to FIG. 2, in an important aspect of the present invention, the housing 130 includes a means for guiding the opposing mating connector 200 (FIG. 6) into the opening 136 and the internal cavity 139 of the housing 130. This guide means may also be referred to as a "keying" means and is shown in the first embodiment as a guide tab 160 that is formed along the front edge of the housing opening or entrance 136. Although only one such guide tab 160 is illustrated, it will be understood that additional guide tabs 162 may be formed in the top wall 131 of the housing 130. Such tabs 162 may be formed by making a U-shaped opening 161 in the top wall 131 to define the edges of the guide tab 162, and subsequently bending the guide tabs 162 down into the internal cavity 137 of the housing 130. The guide tab 160 (or tabs 162) define a positioning point for the opposing mating connector 200. The tabs 160, 162 are preferably aligned along an imaginary line that extends toward the rear of the housing 130.

Figure 7:
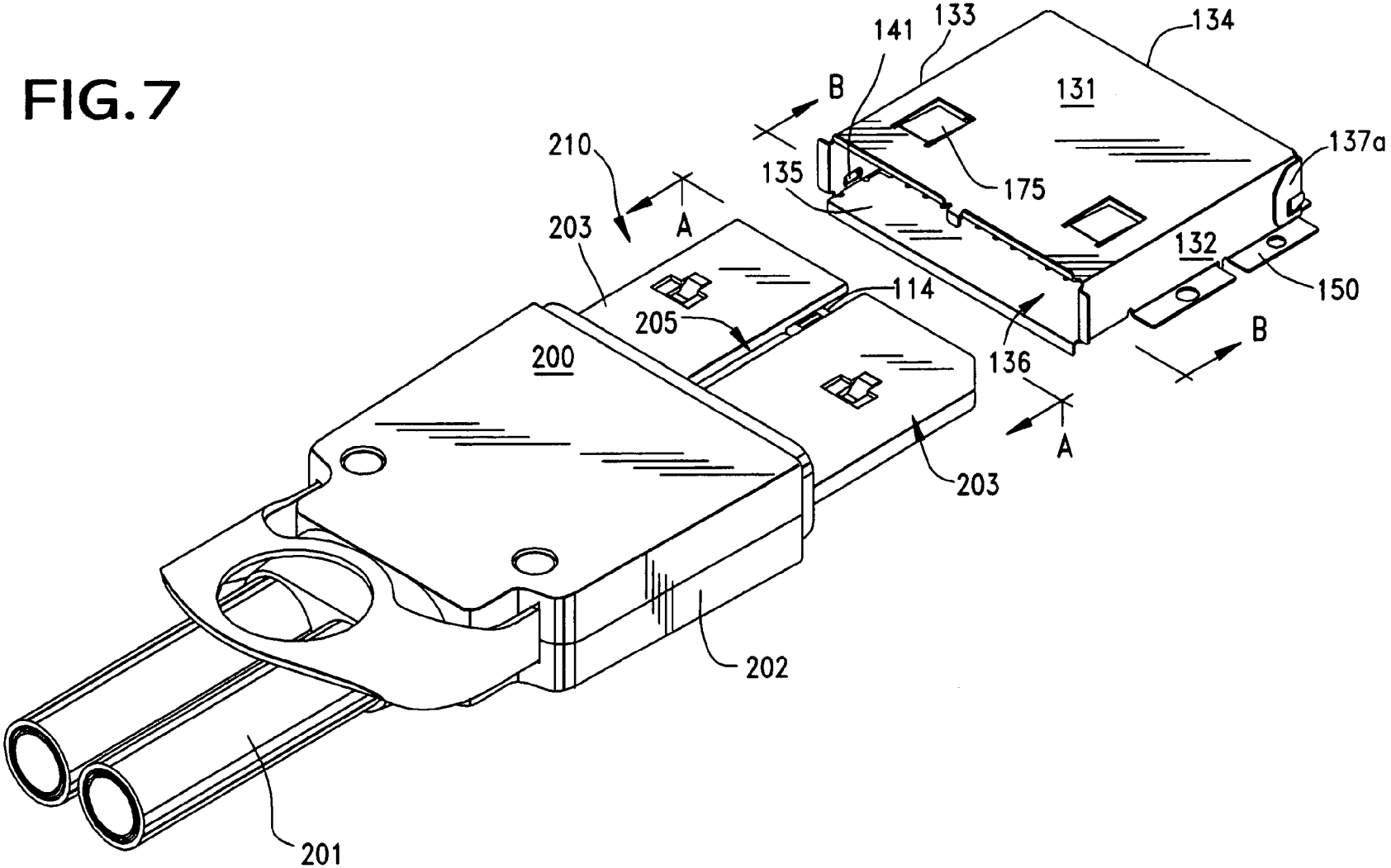
FIG. 7 is an enlarged perspective view of the connector housing of FIG. 4 and an opposing mating connector of FIG. 6 shown in alignment with each other.
Figure 7A:
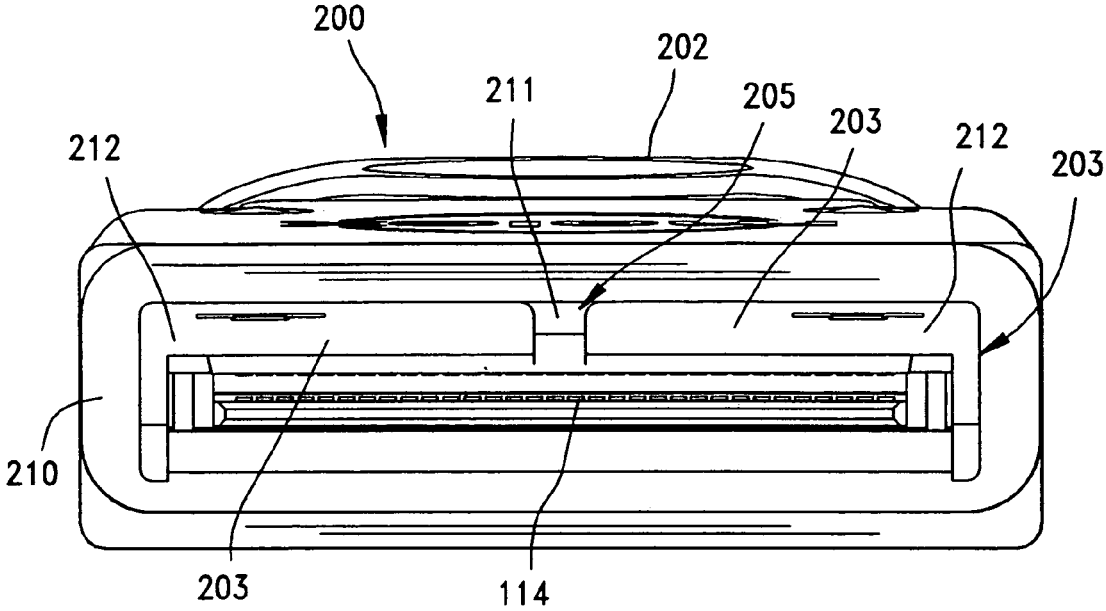
FIG. 7A is an elevational view of the front end of the opposing mating connector, taken along lines A-A of FIG. 7.
Figure 7B:
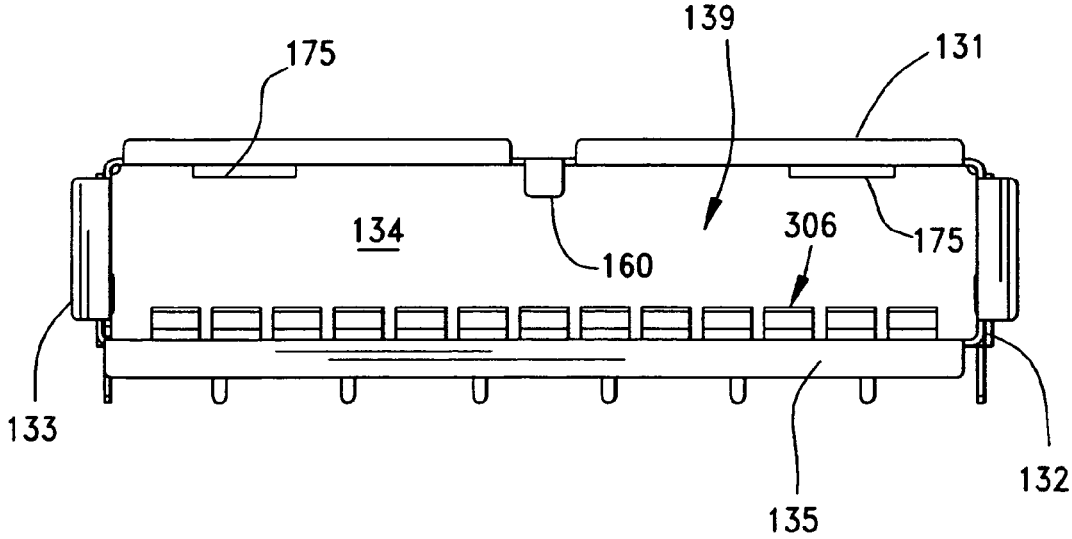
FIG. 7B is an elevational view of the front end of the shield housing of the invention, taken along lines B-B of FIG. 7 and with the shield housing removed from a circuit board and with the interior SFP-style connector removed for clarity.

An opposing plug connector 200 is illustrated in FIG. 6 and it can be seen that the connector includes a housing 202 that is attached to one or more cables 201, each of which preferably includes a plurality of wires (not shown) that are intended to connect with circuits of the circuit board 100. The plug connectors 200 will include one or more male projecting portions in the form of circuit cards 114 that are received within the circuit card slot 112 of the board connector 106. These projecting portions, as well as the rest of the front end 210 of the connector 200 are encompassed by a conductive shield 203. This shield 203 preferably includes a guide slot 205, that may be formed as either a slot 211 that separates the top portion of the shield 203 into two separate parts 212 (FIG. 7A), or as a recess, or channel, in the top portion of the plug connector shield 203, in which case, the top portion will not be divided into top separate portions. This guide slot 205, as shown in FIGS. 6 & 7, preferably extends the length of the plug connector.

Alternatively, the entire shielded housing 130 may be integrally formed as a single die cast piece, with the guide tabs 160, 162 formed as part of the casting process, rather than being stamped from the top portion of the housing 130. In such an embodiment, the guide tabs may extend for the entire depth of the connector. In all of the embodiments of the shielded housing described herein, it is desirable to have some sort of means of engaging the opposing plug connector in place within the housing. Such an engagement means is shown in the drawings as engagement tabs 175 which may be stamped from the top wall 131 of the housing 130 in the embodiments of FIGS. 7 & 8 or they may be cast along with the cover portion 602 of the embodiment of FIGS. 10-12.

Figure 8:
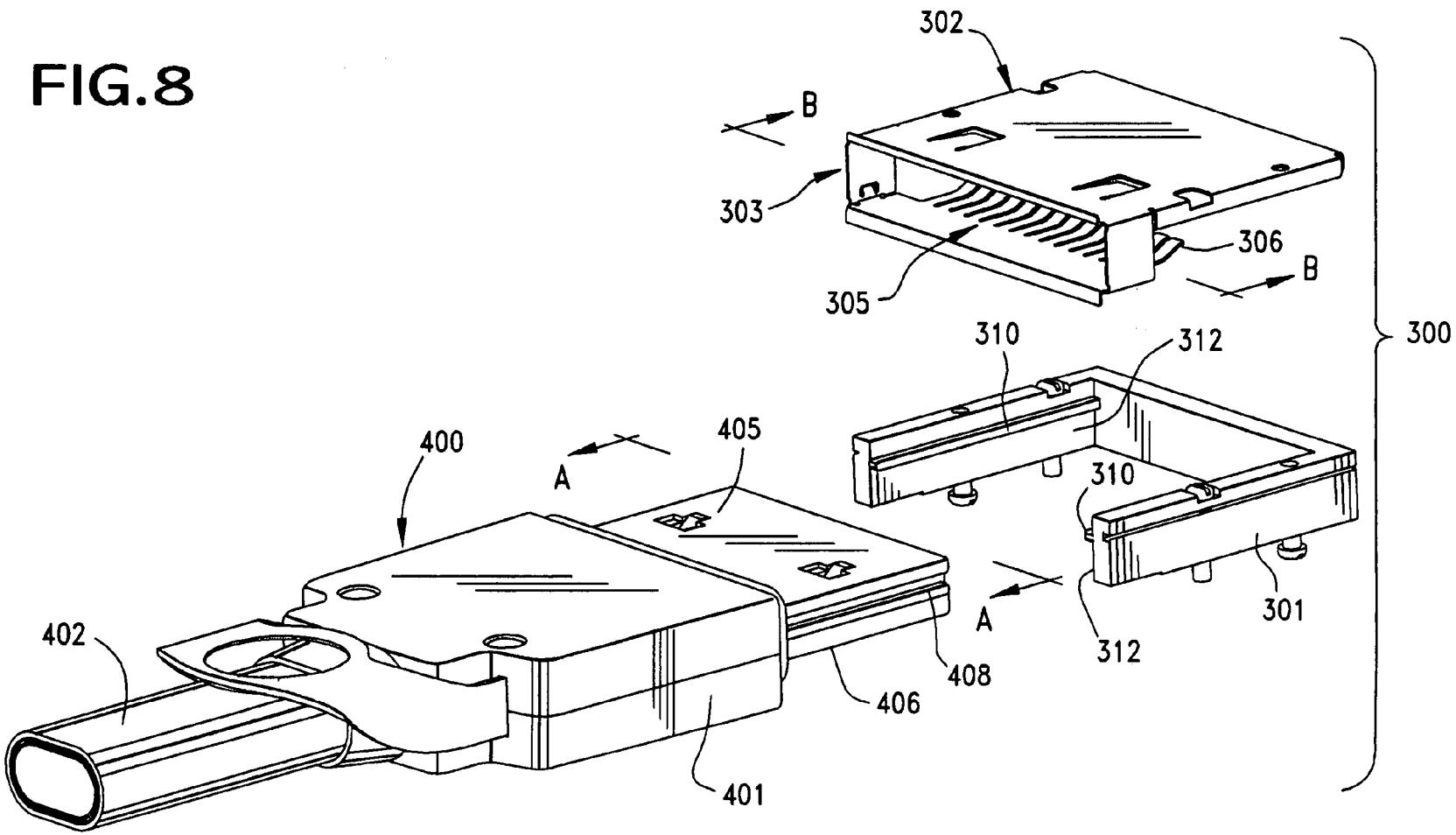
FIG. 8 is an exploded perspective view of another embodiment of a shield housing and mating connector assembly constructed in accordance with the principles of the present invention.
Figure 8A:
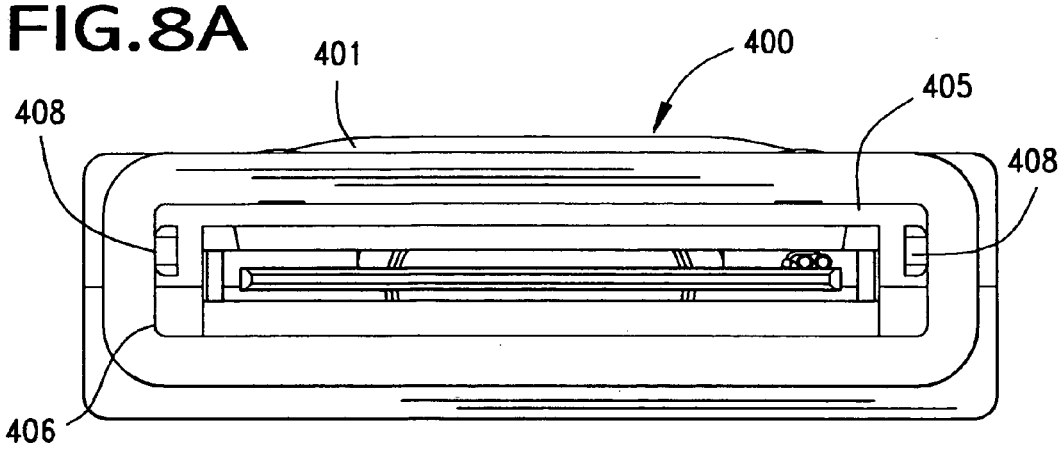
FIG. 8A is an elevational view of the front end of the opposing mating connector, taken along lines A-A of FIG. 8.
Figure 8B:
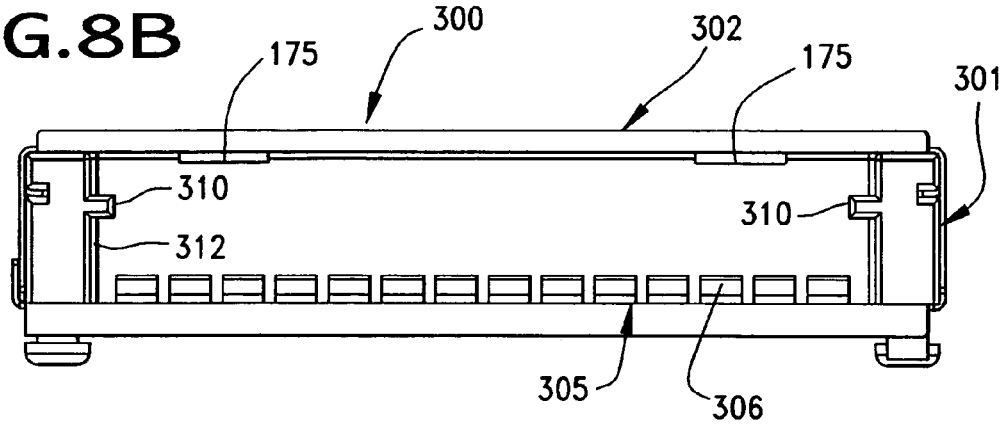
FIG. 8B is an elevational view of the front end of the shield housing of the invention, taken along lines B-B of FIG. 8 and with the shield housing removed from a circuit board and with the interior SFP-style connector removed for clarity.

FIGS. 8-8B illustrate another embodiment of a shielded housing incorporating the principles of the present invention. In this embodiment, the shielded housing 300 is formed from multiple pieces including a base portion 301 that is preferably die cast and a cover portion 302 that is preferably stamped and formed from sheet metal. The cover portion 302, as illustrated, includes an entrance portion 303 formed in a manner similar to the entrance 136 of the shield housing 130 described above. This cover portion, like the shielded housing 130 also includes an EMI gasket 305 incorporated therein, which takes the form of a metal strip that is slotted to provide a plurality of conductive spring fingers 306 that rise up into the internal cavity of the housing 130, 300 in order to contact a conductive bottom surface of the opposing plug connector, 200, 400.

The base portion 301 of the shielded housing shown in FIG. 8 includes a pair of elongated guide rails 310 that are formed on the interior surfaces 312 thereof. These rails 310 provide a means for guiding the connector 400 into place within the internal cavity of the housing 300. The opposing plug connector 400 includes a housing 401 that is attached to a cable 402 and a conductive shield 405 that extends forwardly of the plug connector housing 401. The plug connector shield 405 has grooves 408 formed in its side walls 406 that mate with the guide rails 310 of the housing base side walls. FIGS. 8A & 8B are front elevational views of the plug connector 400 and its shield housing 300, respectively, which illustrate their associated guide rails 310 and the grooves 408.

Figure 9:
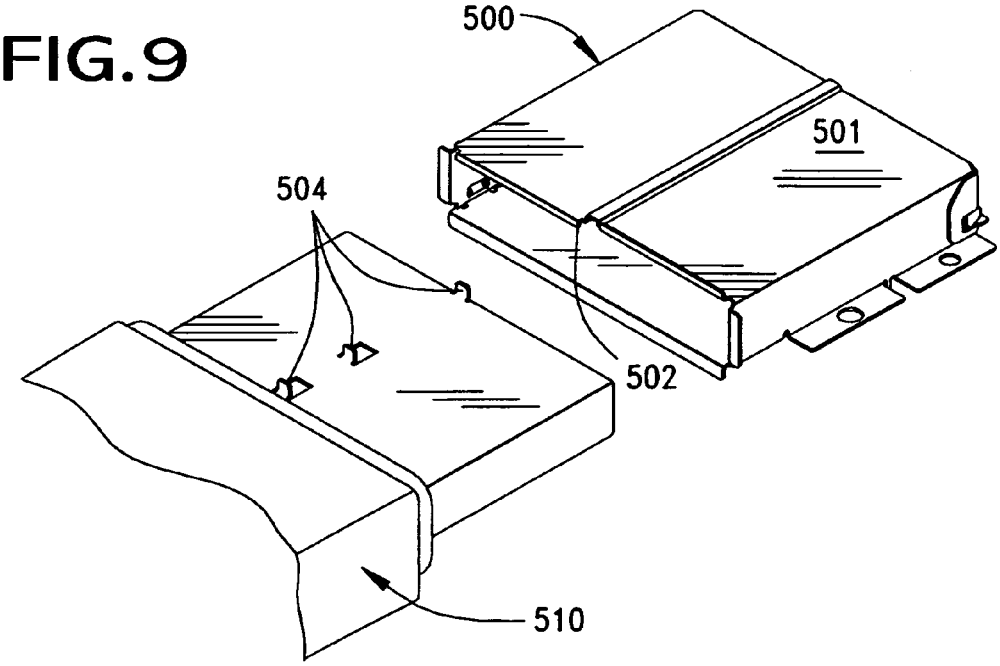
FIG. 9 is a view illustrating another embodiment of a guide mechanism incorporating the principles of the present invention.

FIG. 9 illustrates another embodiment of a shielded housing 500 in which the top wall 501 of the housing 500 includes a groove 502 formed therein which extends for the depth of the housing top wall 501. A corresponding opposing plug connector 510 is provided with one or more guide tabs, or other projections 504 formed in a shield portion 505 of the connector 510 and which are aligned so as to mate with the shielded housing groove 502

Figure 10:
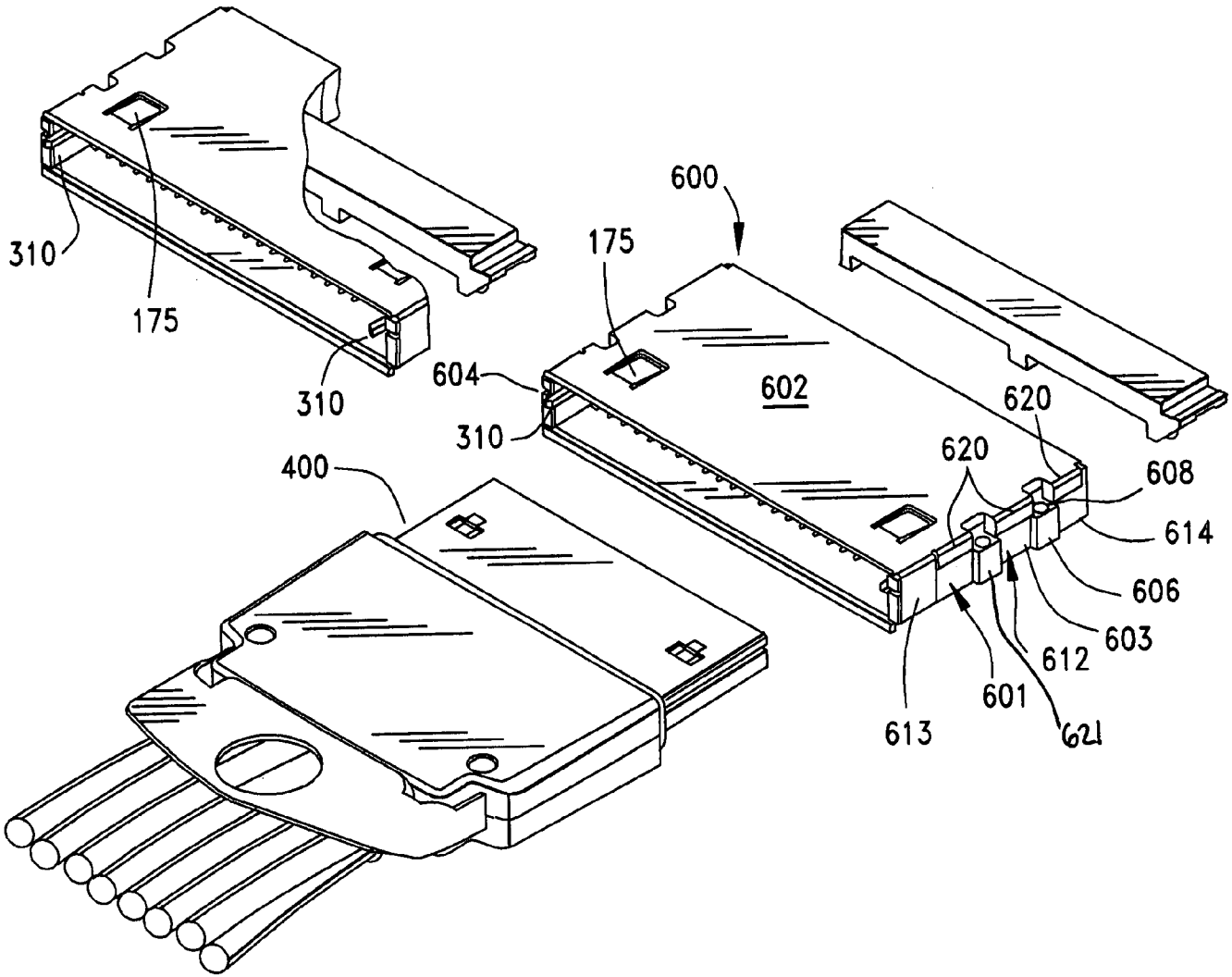
FIG. 10 is an exploded view of another embodiment of a shielded housing assembly incorporating the principles of the present invention.

FIG. 10 illustrates yet another embodiment of a shielded housing 600 constructed in accordance with the principles of the present invention and which is preferably die cast from a conductive material. The housing 600 includes a base 601 and a top cover portion 602. The base portion 601 includes side walls 603, 604 and each of the side walls 603, 604 includes one or more attachment posts 606 that have screw or bolt holes 608 formed therein into which a bolt or screw may be inserted in order to hold the housing to the circuit board 100. The posts 606 slightly project out from the side walls 603, 604 and thus define a slot 612 therebetween and slots 613, 614 respectively ahead of and behind the posts 606.

Figure 11:
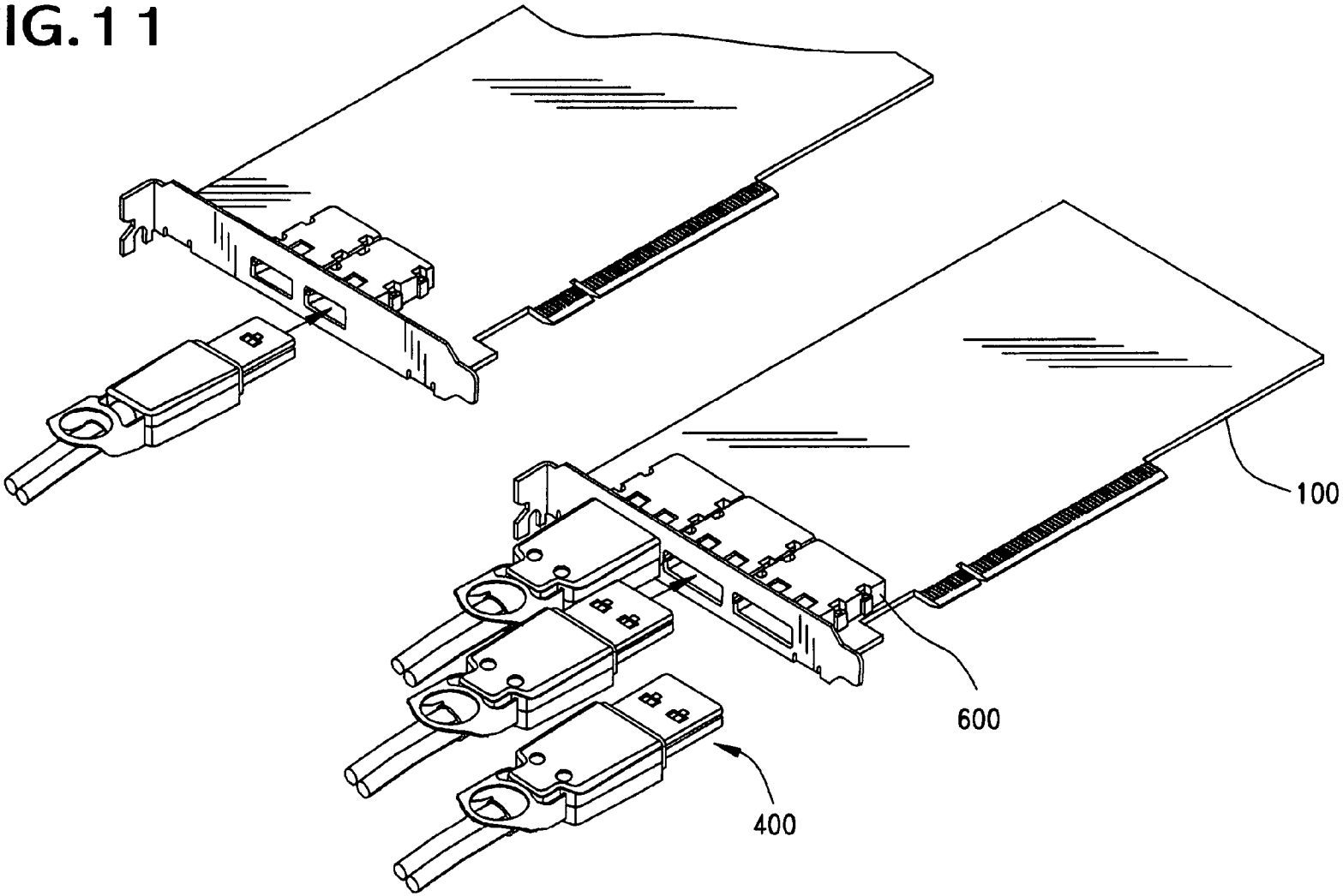
FIG. 11 is a perspective view illustrating a side-by-side arrangement of the shielded housings of FIG. 10.
Figure 12:
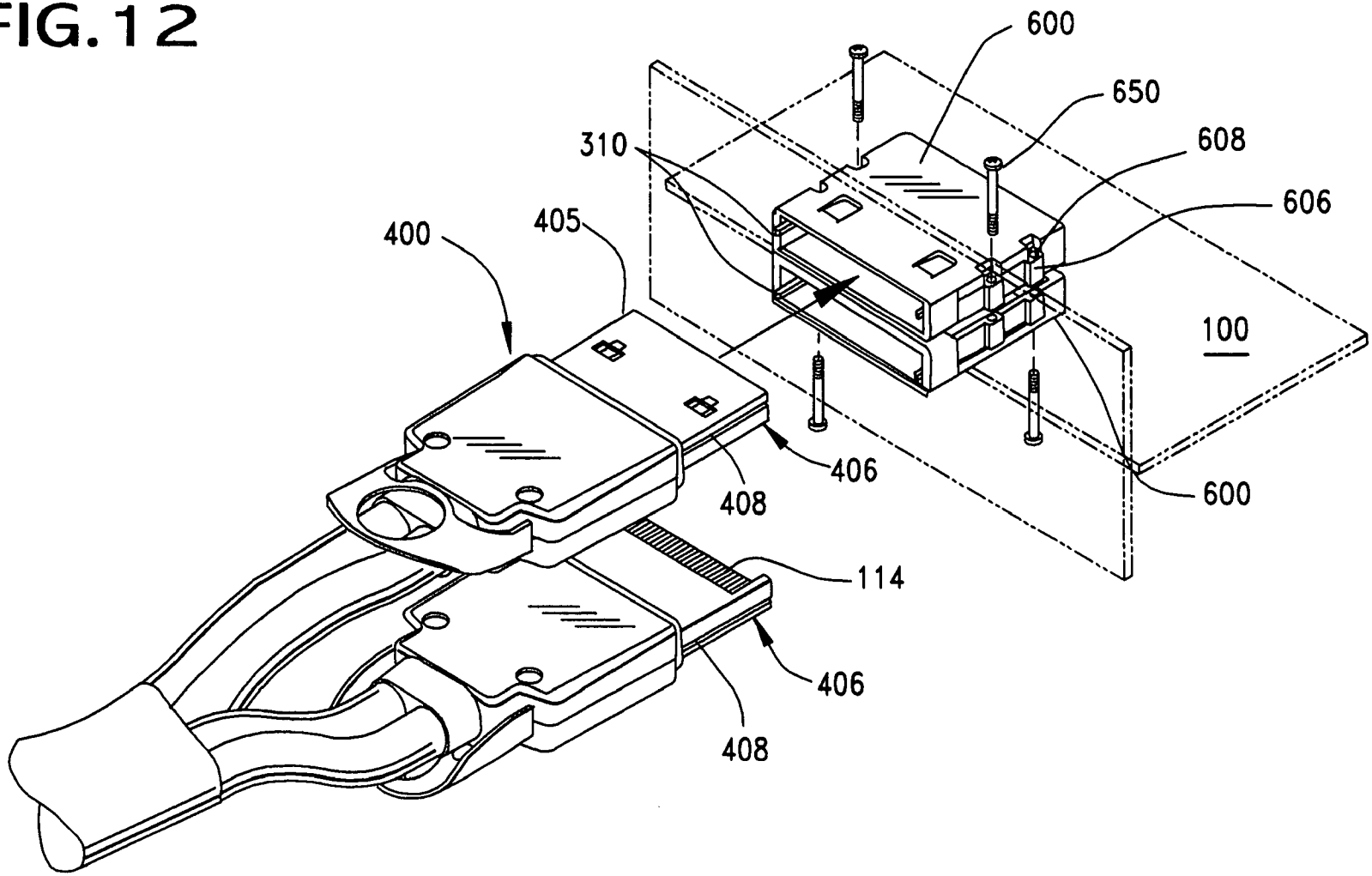
FIG. 12 is a perspective view of two of the housings of FIG. 10 arranged in a belly-to-belly arrangement on opposite sides of a circuit board.

The posts 606 on each of the sidewalls 603, 604 are staggered in their locations so that two such housings may be placed closely together on a circuit board 100 as shown in FIG. 11. In this regard, the posts 606 on the right side wall 604 will fit in the grooves 612-614 on the left side wall 604 of the shielded housing 600. In order to accommodate an even closer spacing, the grooves 612-614 are preferably recessed, meaning that the cover portion 602 includes top edges 620 that extend slightly out to the side to create a space thereunder into which the outer sides 621 of the posts 606 may fit. This fit is shown generally in FIG. 11. The housing 600 includes guide rails formed on the interior surfaces of its two side walls in the same manner as described above.

FIG. 11 illustrates two housings 600 of the invention arranged on opposite sides of a circuit board, which is commonly referred to in the art as a "belly-to-belly" arrangement. In this instance, the mounting screws 650 extend through the holes 608 in one set of mounting posts 606 for one housing 600 and into holes in the other set of mounting posts for the other housing.

Figure 13:
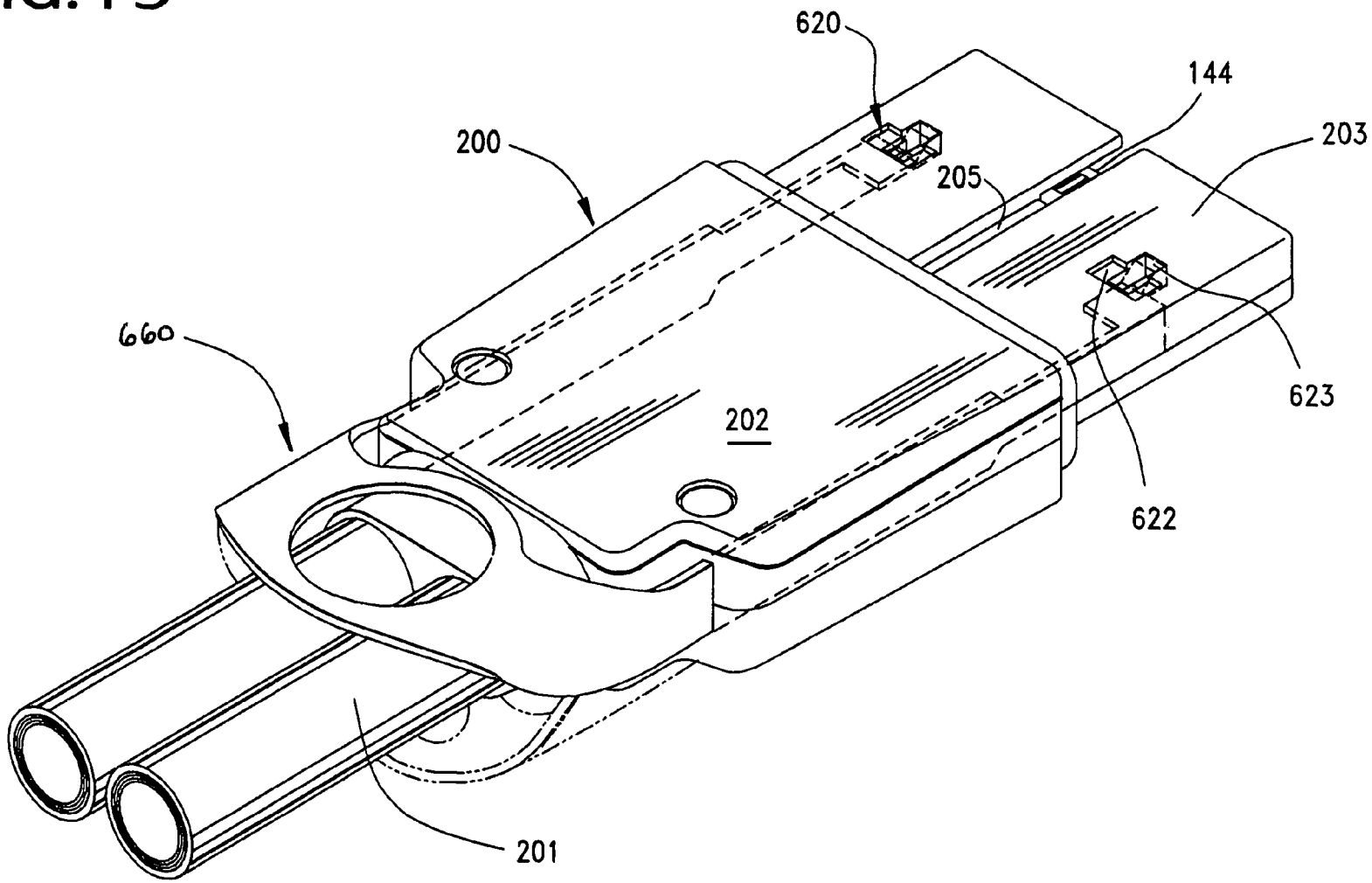
FIG. 13 is a perspective view of a plug connector incorporating a latching mechanism constructed in accordance with the principles of the present invention.
Figure 14:
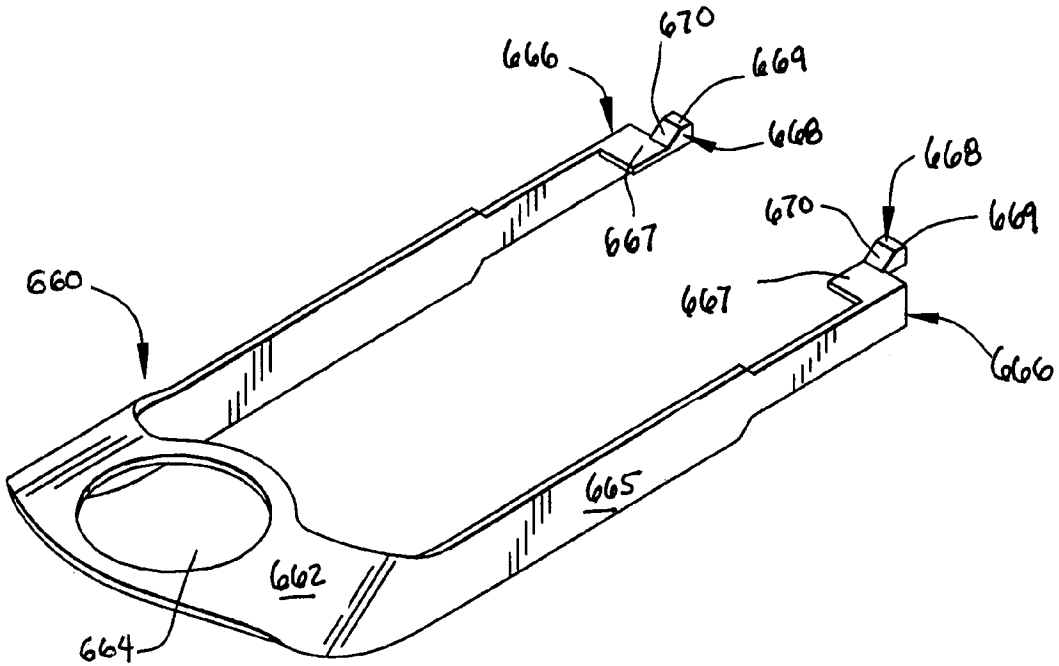
FIG. 14 is a perspective view of the latching mechanism used in the plug connector of FIG. 14.

FIG. 13 illustrates the plug connector 200 with a mechanism 660 constructed in accordance with the principles of the present invention that permits the user of the plug connector to disengage, eject, or otherwise delatch the plug connector from its mating engagement with the shielded housing of the board-mounted receptacle connector. As best seen in FIG. 14, this delatching mechanism 660 includes an actuator having a base, or handle portion 662 with a hole 664 for a user's finger to fit in and operate the mechanism shown. Two actuator arms 665 extend in a spaced-apart fashion forwardly from the handle portion 662 and the actuator arms 665 terminate in free ends 666. At the free ends 606, two tabs 663 extend inwardly from the actuator arms 665 to define a pair of slide surfaces 667. Each slide surface 667 includes an actuating end 668 which is illustrated as a cam block 669 having an angled cam surface 670. The cam surface 670 is angled downwardly in a direction from the actuating ends 668 to the handle 662 of the delatching mechanism 660.

Figure 15:
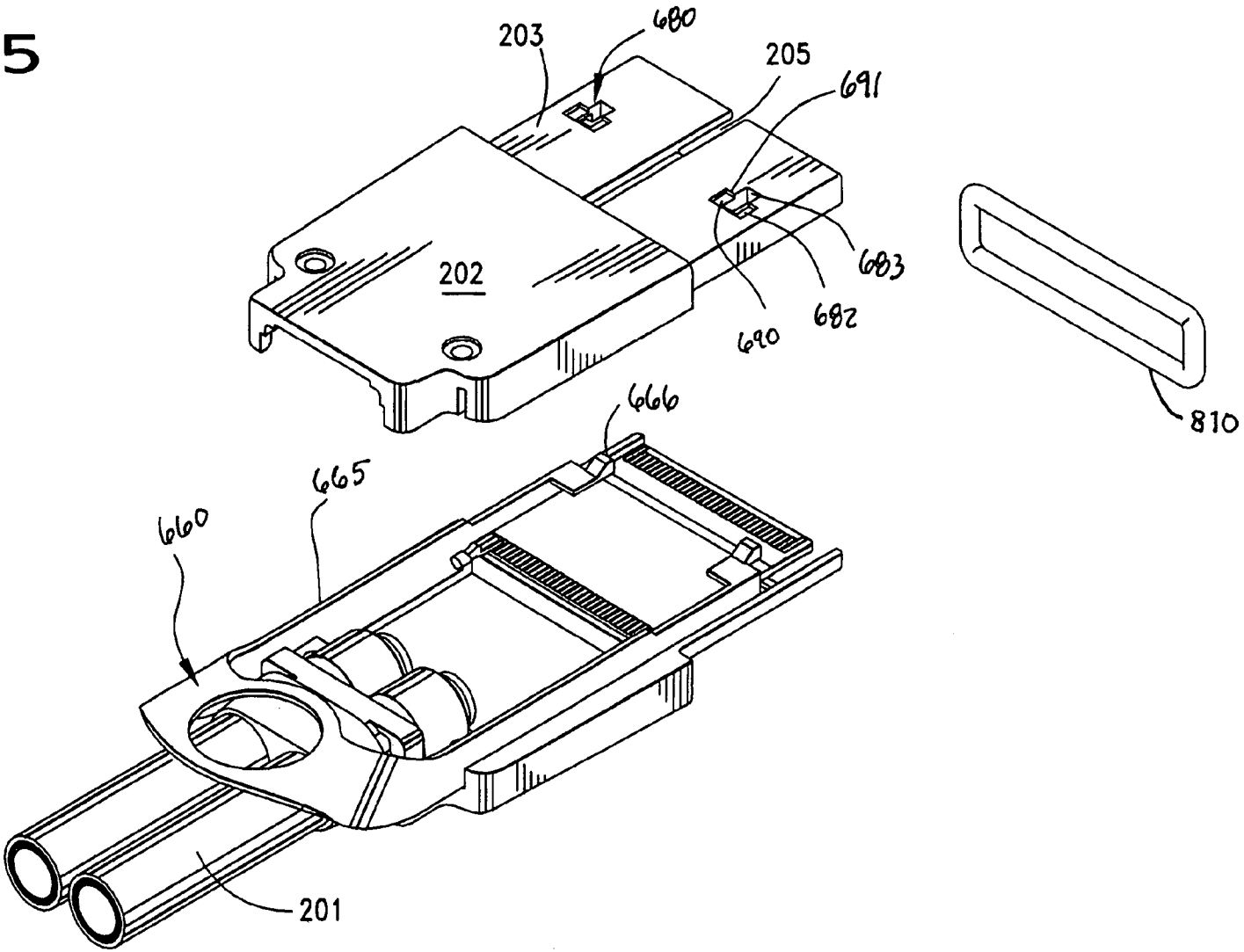
FIG. 15 is an exploded view of the plug connector of FIG. 13.

As shown in FIG. 15, a portion of the delatching mechanism 660 is contained within the plug connector housing 202, specifically the actuator arms 665. The free ends 666 of the actuator arms 665 project out of the connector housing 202 and the entire assembly 660 is slidable within the connector housing 202. The delatching arm free ends 666 extend into the forward area of the plug connector and into the area between the conductive shell portions 203 of the plug connector 200. The outer shell 203 of the plug connector includes a pair of openings 680, shown as T-shaped openings that have a lateral part, or leg portion, 683 and a transverse part, or cap portion, 682. The cam portions of the actuator arms 605 are shown as solid blocks which are aligned with these openings 680.

Figure 16:
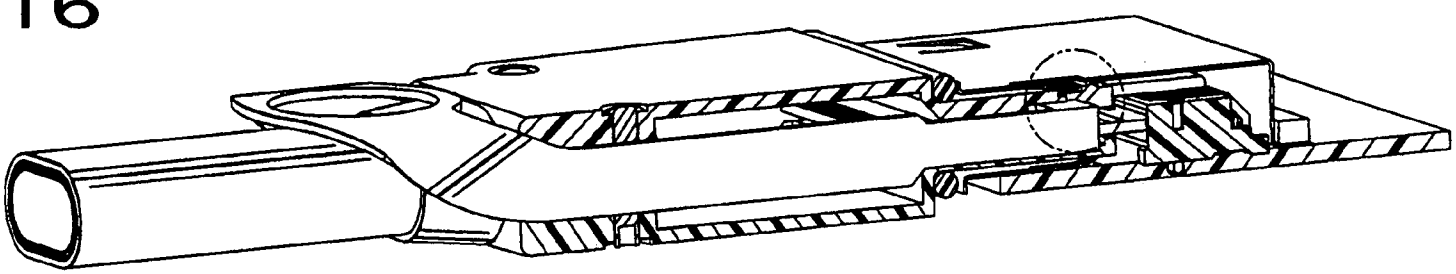
FIG. 16 is a cross-sectional view of the plug connector of FIG. 13, taken along a line that permits view of the latching arm free ends.

The cap, or transverse parts, 682 of these plug connector openings 680 act as receptacles for the engagement tabs 175 of the board-mounted shielded housing as shown best in FIG. 16 A-C. The ends of the engagement tabs fit into these openings 682 and they bear against bottom surfaces 690 of the openings 680, as well as against an end wall 691 thereof. This interference fit prevents the plug connector 200 from disengaging from the circuit board connector 106 and the shielded housing 130. In order to provide a means for unlatching the plug connector 200 from the shielded housing 130, the cam portions 669 are aligned with and received within the openings 680, and the typically occupy the leg part 683 of the openings 680. Movement of the delatching mechanism and the cam portions 669 will cause contact with the engagement tabs 175 and lift them out of their engagement with the plug connector shell 203.

Figure 16A:
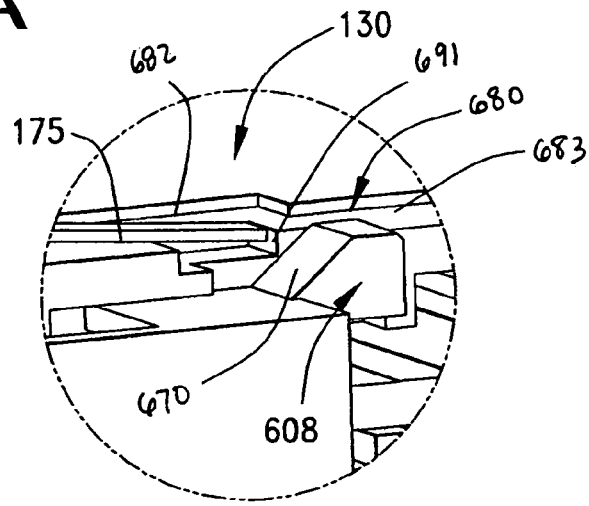
FIG. 16A is an enlarged detail view of the latching mechanism cam block in place in the plug connector and with the engagement tab of the shielded housing fully engaged with the plug connector.
Figure 16B:
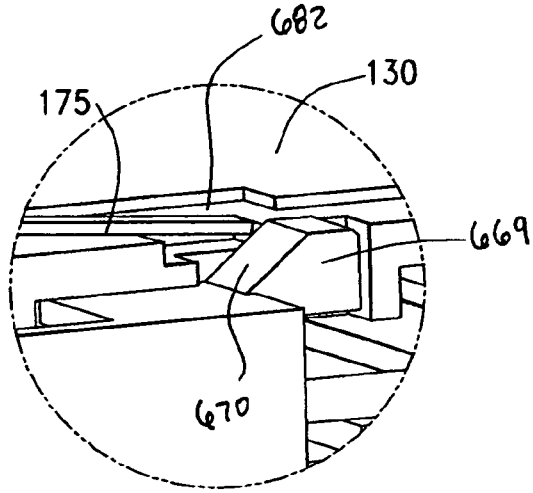
FIG. 16B is the same view as FIG. 16A, but showing the latching mechanism cam block being moved rearwardly within the plug connector and the shielded housing into contact with the engagement tab thereof.
Figure 16C:
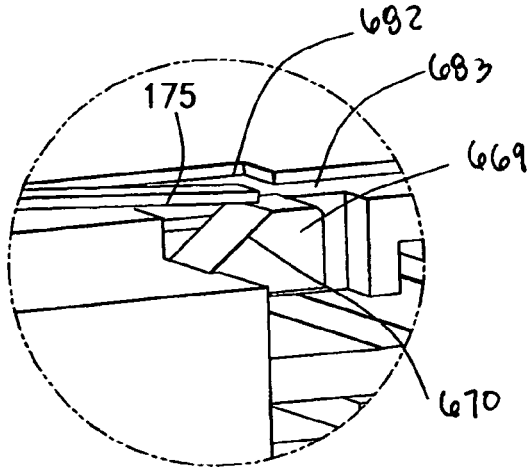
FIG. 16C is the same view as FIG. 16B, but showing the latching mechanism cam block fully engaged with the engagement tab of the shielded housing.
Figure 19:
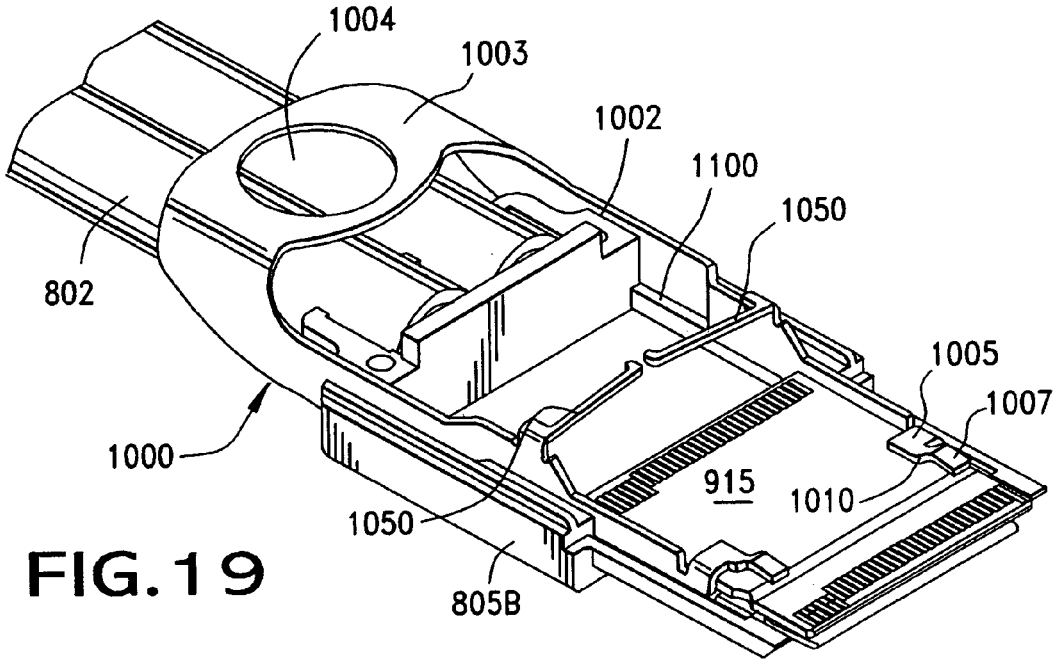
FIG. 19 is the same view as FIG. 18, but with the plug connector cover removed for clarity.

FIGS. 16A-C illustrate the manner of operation of the delatching mechanism best. In FIG. 16A, the mechanism is in a first operative position, where the plug connector 200 is latched in engagement with the shielded housing 130. As shown, the end of the engagement tab 175 rests against the inner wall 691 of the opening 680. In FIG. 16B, the delatching mechanism has begun to be moved to its second operative position and the cam block cam surface 670 is confronting the end of the engagement tab 175. In FIG. 16C, the delatching mechanism has been pulled backward so that the cam portion 669 and its cam surface 670 have made contact with the end of the engagement tab 175, urging it upwardly within the opening 680 and out of contact with the end wall of the opening 680. In practice, the top part of the cam portion (block) preferably extends partially out of the openings 680 so that the lifting of the engagement tabs 175 of the shielded housing 130 is complete.

The handle 660 of the delatching mechanism is shown as extending along one side of the cable 202. It may be extended as shown in dashed line to the other side of the cable 202, or below as shown in FIG. 13.

An alternate embodiment is generally shown in FIG. 17 and the handle of this delatching mechanism 700 includes a solid tab that may be drawn rearwardly. In this embodiment, only one actuator arm is used having a single cam block 703 at its free end, and the shielded housing has only a single engagement tab 175 formed therewith.

Figure 23:
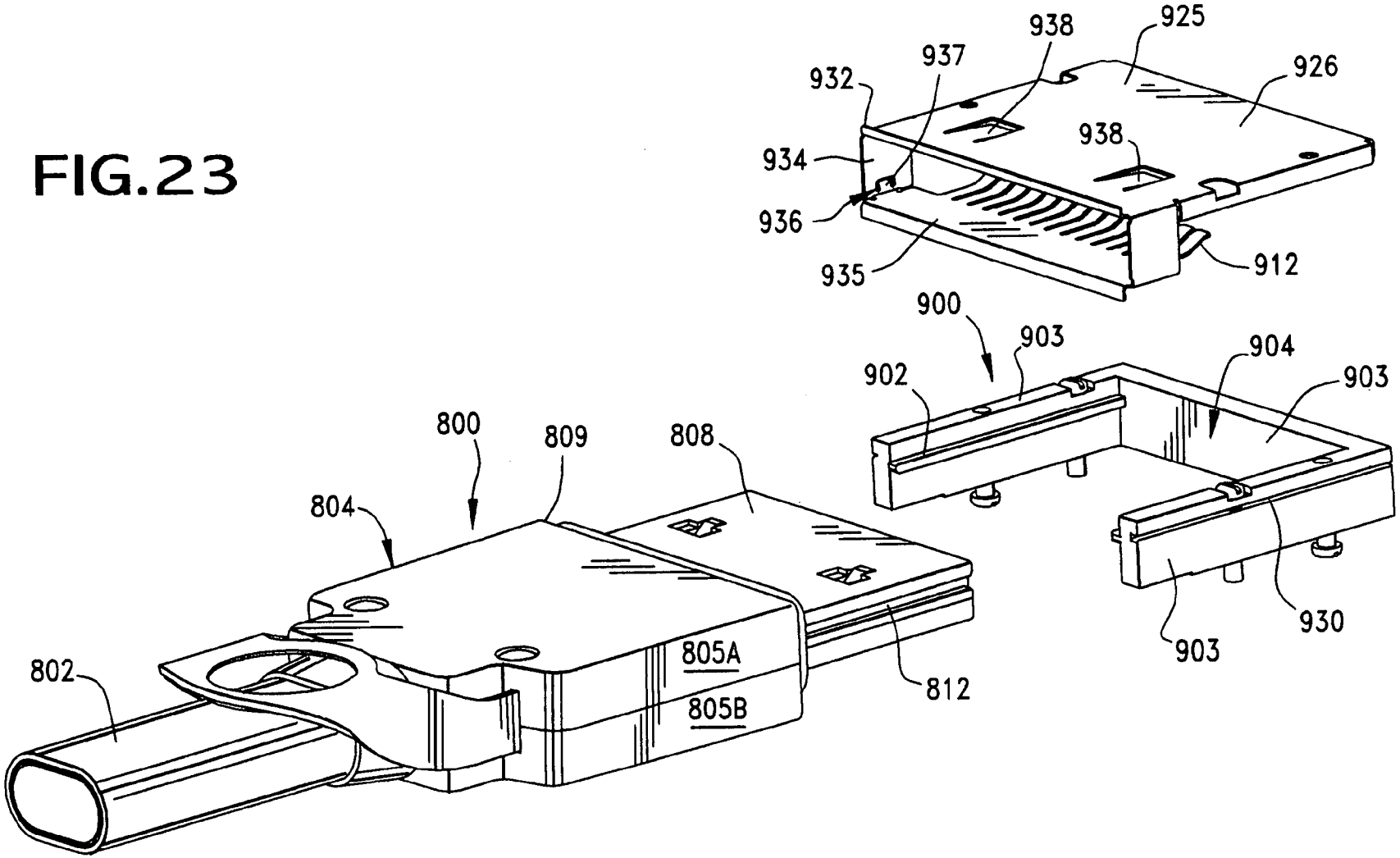
FIG. 23 is an exploded perspective view of a guide frame used in conjunction with the plug connector of FIG. 18.
Figure 24:
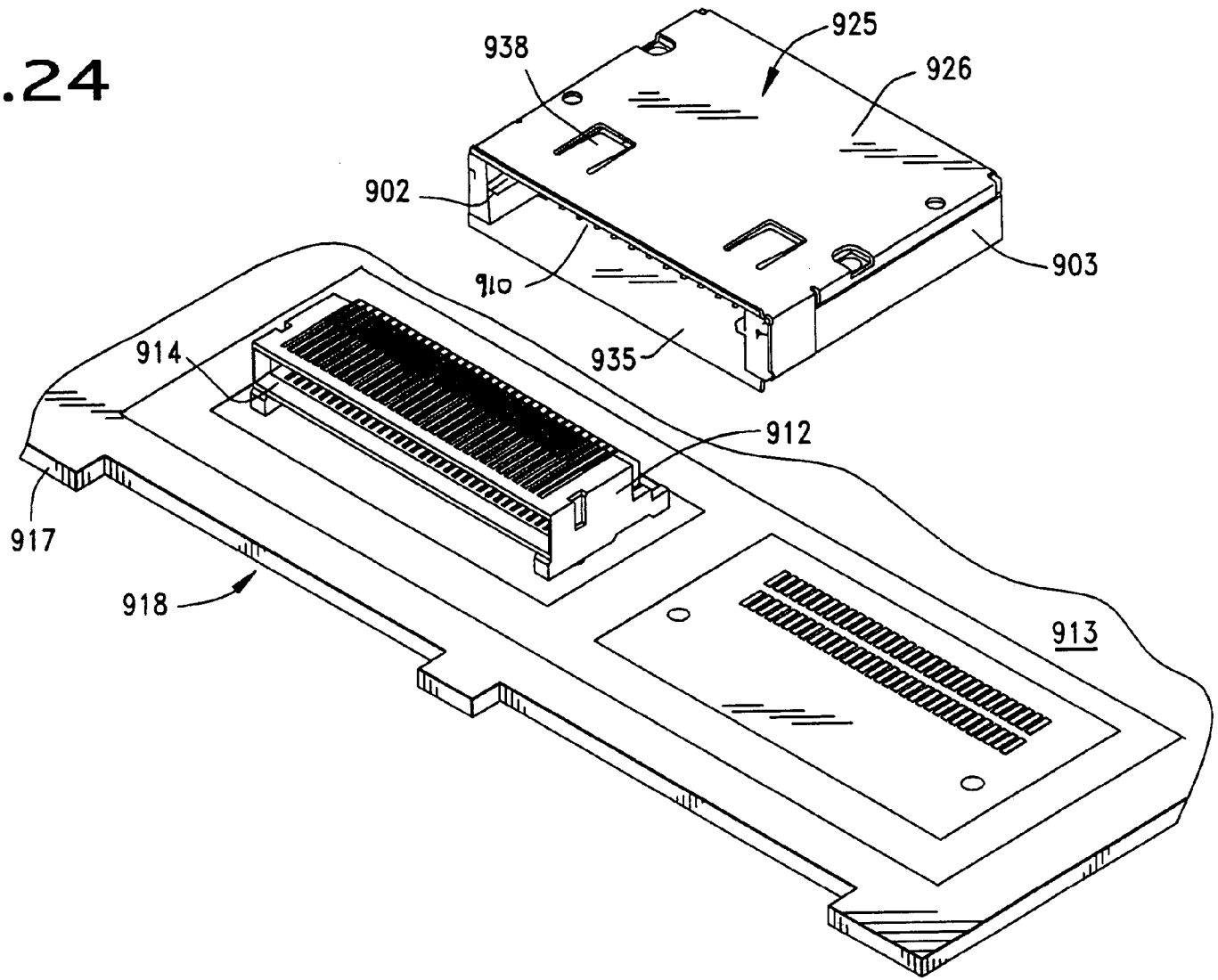
FIG. 24 is a partial detail view of a surface mount connector and an assembled guide frame of FIG. 23 shown in position for fixing to a printed circuit board.

FIGS. 18-24 illustrate a plug connector 800 that incorporates another embodiment of a delatching mechanism constructed in accordance with the principles of the present invention. The plug connector 800 shown in these Figures is used to terminate a plurality of wires housed in cables 802. The cables 802 enter a housing 804, which, as illustrated, is formed from two halves, a top half 805A and a bottom half 805B. Each half 805A, 805B has a wide body portion 806 and a thin plug portion 808 that projects from the front face of the connector 804. A flexible and conductive gasket 810 may be applied to the plug portion 808 (as with the other embodiments) to provide a suitable EMI seal between the plug connector 800 and an opposing guide frame into which it fits. (FIGS. 23 and 24.)

The plug portions 808 of the plug connector 800, as shown in FIG. 23 may include a pair of slots 812 formed in their opposing sides. These slots 812 receive complementary-shaped guide rails 902 of a corresponding guide frame 900. The guide frame is U-shaped and is shown to include three walls 903 that are preferably formed from a conductive material and as such, they are preferably die cast from a metal. They cooperatively define a hollow enclosure 904 that encloses a surface mount receptacle connector 910, that is shown best in FIG. 24 as having a mating slot 914 that receives the edge of a circuit card 915 mounted in the plug connector 800. The connector 912 is mounted to the surface of a printed circuit board 913 proximate to an edge 917 of the board 913.

In order to complete the guide frame enclosure, a conductive cover 925 is preferably provided. This cover includes, as illustrated, a cover plate 926 with a pair of opposing side clips 928 that may extend down over a part of each sidewall 903 of the guide frame 900 and engage a slot 930 formed therein. A front frame portion 932 is also preferably formed as part of the cover 925 and includes two sidewalls 934 and a base wall 935 that are connected together, as at 936, with a tab 937. This front frame portion 932 forms an opening of the guide frame that receives the plug portion 808 of the plug connector 800. The base wall 935 may be slotted along one end thereof within the guide frame enclosure 904 to provide a plurality of conductive spring fingers 912 that are biased, as shown, upwardly so that they contact the bottom surface of the plug connector plug portion 808 when inserted into the guide frame 900. The cover 925 includes a pair of latch tabs 938 which are stamped into the cover and which depend into the enclosure 904 in the manner described with the other embodiments discussed above. A portion of the base wall may project and fit into a slot 918 that is formed along the edge 917 of the circuit board in front of the connector 912.

Figure 20:
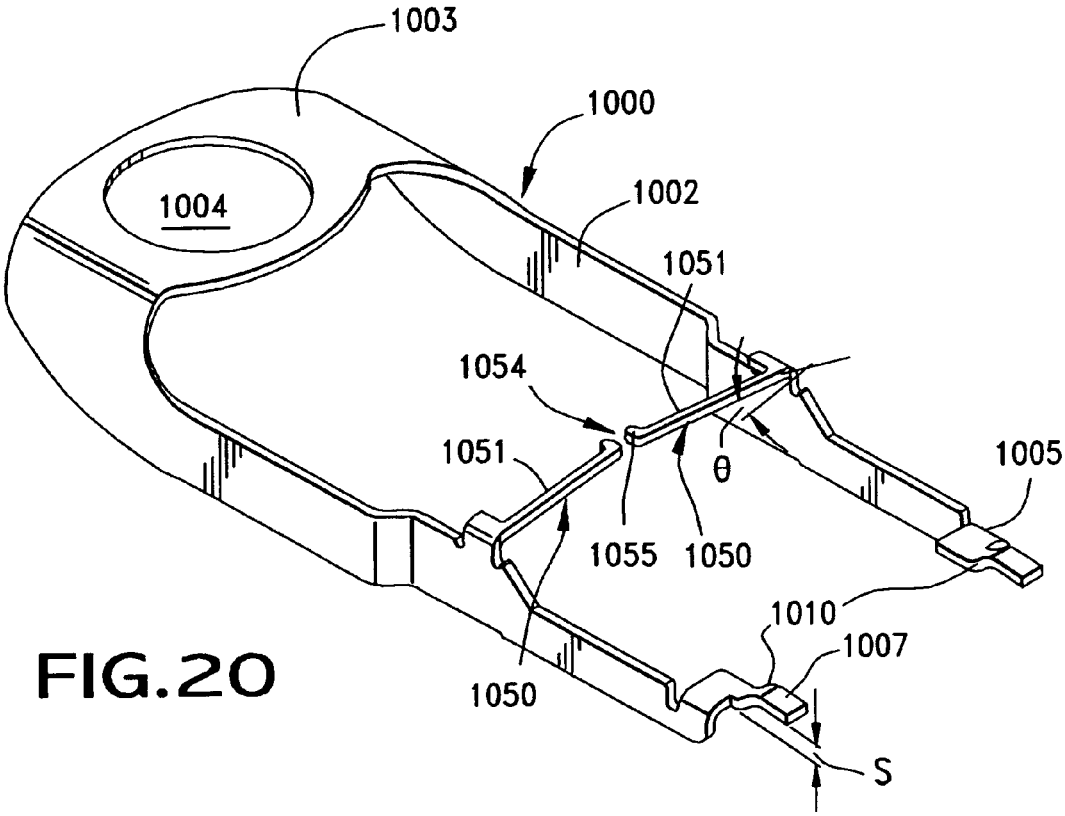
FIG. 20 is a perspective view of the delatching actuating mechanism used in the plug connector of FIG. 18.

FIG. 20 illustrates the delatching mechanism 1000 that is utilized in the plug connector 800. As shown, it includes a pair of elongated arms 1002 that extend lengthwise from a rear handle portion 1003 that has a wide body with a central opening 1004 to define a pull tab structure for a user to grip with one or more fingers. Each arm 1002 terminates in a free end 1005 and each such end 1005 is folded over 90 degrees into a plane that is transverse to the length of the arms. The free ends 1005 have a delatching tab 1007 that sits in the transverse plane but may be offset and spaced apart therefrom as shown. The tabs 1007 are spaced apart from the base of the ends by a spacing S. When viewed from a side, the free ends 1005 have an S-shaped configuration.

The offset end preferably includes a ramped cam surface 1010 that is moved rearwardly against the ends of the latching tabs 938, and which, due to the rearward movement of the free ends lifts the latching tabs up and out of engagement with the openings of the plug connector plug portion 808. As shown best in FIG. 19, the arms 1002 of the delatching mechanism are held in slots or channels 1100 that are preferably formed in both of the top and bottom plug connector halves 805A, 805B.

In an important aspect of the present invention, the delatching mechanism 1000 is provided with means for retaining it to an initial position after it has been actuated to delatch, or release the plug connector 800 from a corresponding receptacle connector. This return means is best illustrated in FIGS. 19-22. It preferably includes, as shown, a pair of return springs 1050 in the form of a pair of arms 1051 that are shown as formed with the actuator arms 1002 and are stamped and formed, or otherwise bent over out of the lengthwise plane(s) in which the actuator arms 1002 extend and into their own plane that is generally transverse, or at least offset from the actuator arms 1002. The free ends 1005 preferably extend in a plane that is above and generally parallel to the horizontal plane that the plug connector circuit board 915 extends. In this manner, the return spring arms 1051 will lie in an open space underneath the plug connector top half 805A. This relationship is illustrated best in FIG. 21.

As shown, the return spring arms 1051 extend slightly rearwardly at an angle θ (FIG. 20) to impact an initial bias to the return spring arms 1051 and the overall actuator 1000. The return spring arms 1051 are shown as having free ends 1054, each of which includes a rearward extending finger 1055. These fingers 1055 are aligned with a reaction block 1075 that is formed with or otherwise disposed on the inner surface of the plug connector top half 805A. (FIGS. 21 and 22.) Preferably, the reaction block 1075 is aligned with a central longitudinal axis of the plug connector housing such that the fingers 1055 are also aligned with that axis, and further preferably lie on opposite sides thereof.

During delatching, the user pulls the finger tab 1003 rearwardly in the direction of arrow R in FIG. 18 and the return spring finger 1055 contact the reaction block 1075 and in particular, the front surface 1076 thereof. Rearward movement of the actuator causes the spring return arms to collect forwardly as shown in phantom lines in FIG. 22. The return spring arms 1051 are resilient due to their thin cross-section and their material, preferably a spring steel with high elastic properties, and they will tend to return to their original position when the user releases the actuator, thereby moving the actuator forward and the actuator arm ends back into position.

Figure 25:
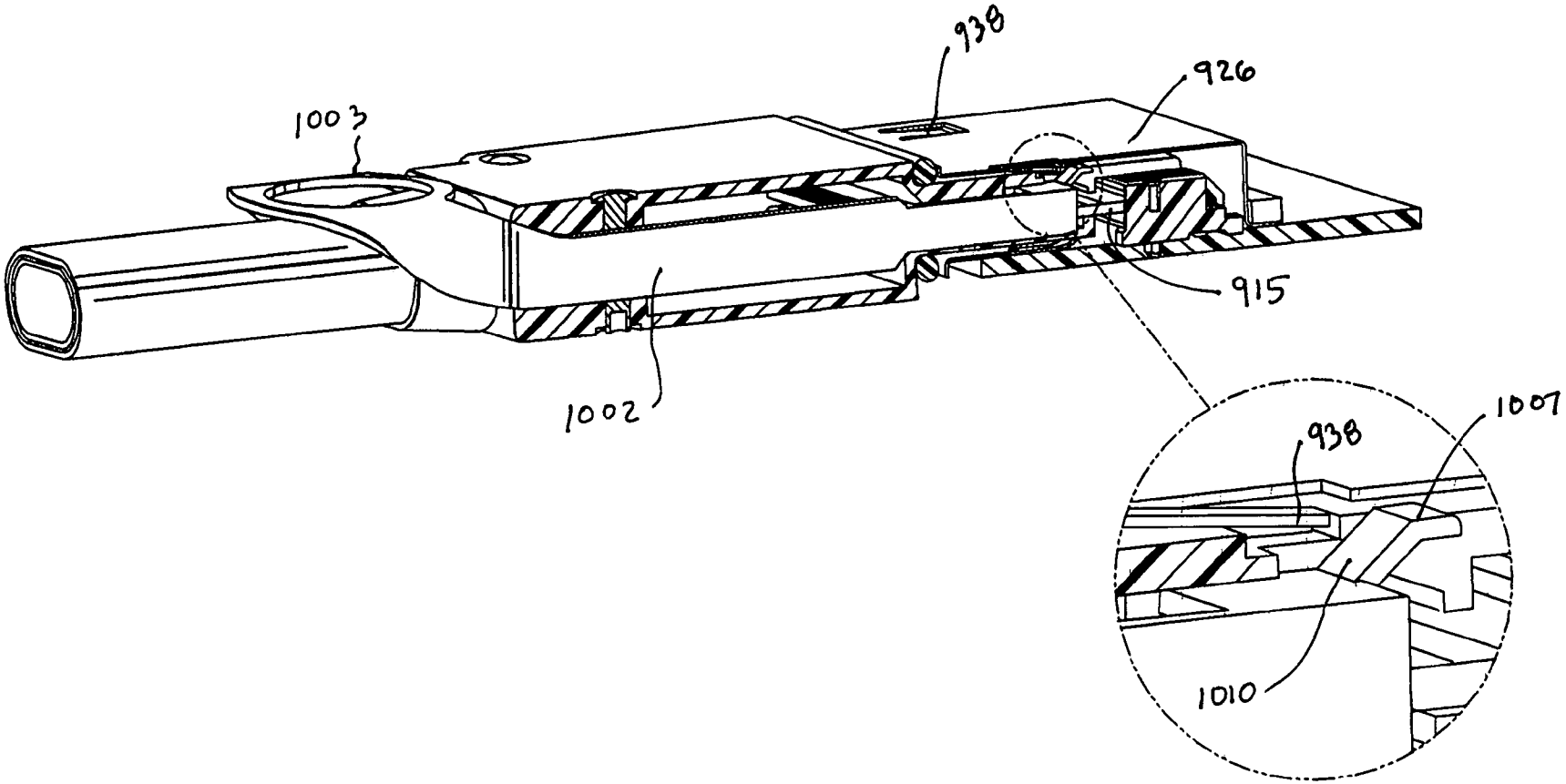
FIG. 25 is a side sectional view of the plug connector engaged in place within a shielded housing and in the detail inset, the engagement between the shielded housing engagement tab and the plug connector housing.
Figure 26:
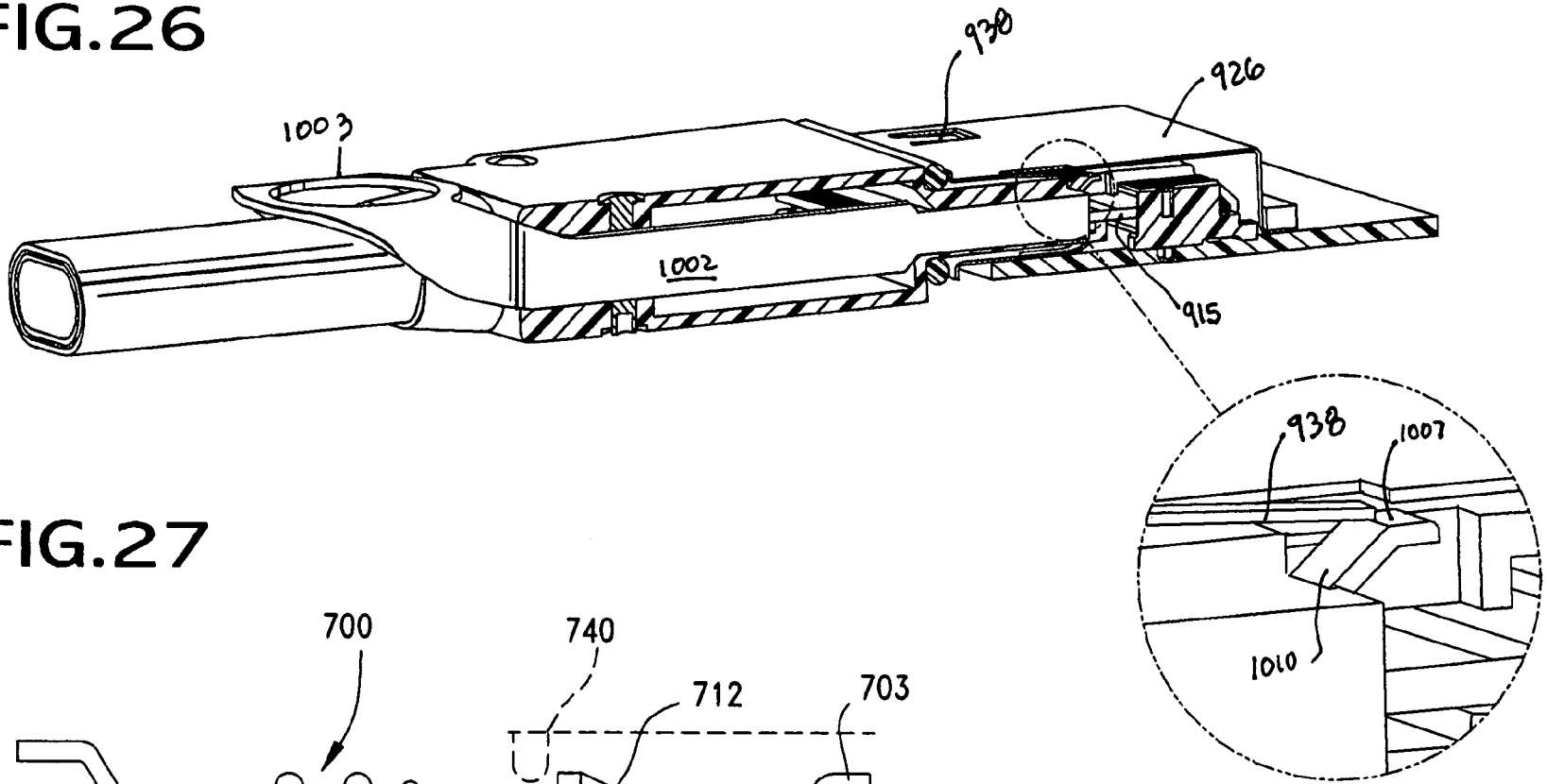
FIG. 26 is the same view as FIG. 25, but illustrating the delatching mechanism in operation and in the inset the contact made by the actuator arm cam portion against the shielded housing engagement tab; and, FIG. 27 is a diagrammatic view of an alternate embodiment of a delatching mechanism that may be used with the plug connector embodiment of FIG. 17.

FIGS. 25 & 26 illustrate the action of the cam portions at the free ends of the actuator arms. It can be seen that movement of the actuator rearwardly will bring the cam portions into contact with the engagement tabs of the shielded housing and present a slanted surface for the engagement tabs to ride up on and out of engagement with the openings of the plug connector housing.

Figure 27:
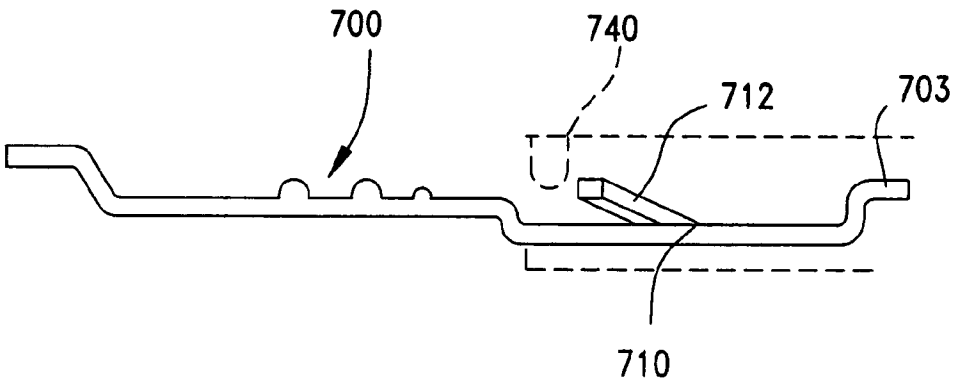

FIG. 27 shows diagrammatically a return spring structure that may suitable for use on a single actuator as is shown in the embodiment of FIG. 17. The actuator 700 in that embodiment has a pull tab portion 701 a recessed portion 710 that is held within the plug connector housing and a free end with a cam portions 703. A single return arm 712 is shown as stamped out of the body of the recessed portions 710 and is brought into contact with a reaction surface, shown as shoulder 740, in phantom. Operation of this embodiment occurs in the same manner as explained above.

While the preferred embodiment of the invention have been shown and described, it will be apparent to those skilled in the art that changes and modifications may be made therein without departing from the spirit of the invention, the scope of which is defined by the appended claims.

What is claimed is:

1. An electrical plug connector including a delatching mechanism having return action, said plug connector comprising:

a plug portion adapted to matingly engage a housing for mounting to a printed circuit board, the housing having a latch tab, said plug portion having a recess positioned to engage the latch tab of the housing adapted for mounting to the printed circuit board when the plug connector is in an engaged mode with respect to the housing;

the delatching mechanism interacts with said latch tab to move same out of engagement with said recess of the plug connector when the mechanism is in a delatching mode, the delatching mechanism including a handle that is disposed exterior of said plug connector and a delatching tab disposed at a free end of said delatching mechanism opposite the handle, the free end and the delatching tab being disposed within said plug connector, said handle including an opening disposed therein to facilitate grasping thereof by a user; and, at least two return spring arms which impart return action to said delatching mechanism when said delatching mechanism is in the engaged mode, rearward movement of said handle with respect to said plug portion causing each said return spring arm to exert a force in opposition to the rearward direction movement of said handle, said delatching mechanism includes two actuator arm members extending longitudinally from said handle, said actuator arm members include said return spring arms extending transversely thereto, and each of said return spring arms includes a free end disposed within said plug portion and proximate to a central longitudinal axis of said plug portion.

2. The plug connector of claim 1, wherein said delatching tab includes a S-shaped profile when viewed from a side thereof.

3. The plug connector of claim 2, wherein said delatching tabs each include an angled cam block partially disposed with said plug portion.

4. The plug connector of claim 1, wherein each of said actuator arm members terminates in a cam end.

5. The plug connector of claim 1, where said return spring arm free ends include enlarged reaction portions.

6. The plug connector of claim 5, wherein said plug portion includes at least one reaction surface aligned in opposition to said return spring free ends.

7. The electrical plug connector of claim 1, wherein said delatching mechanism includes a pair of elongated arms extending to the end of the delatching mechanism opposite the handle, and each said free end of the delatching tab is spaced internally away from said elongated arms of the delatching mechanism.

8. A plug connector comprising:

a plug connector housing, the plug connector housing including a hollow interior which supports a circuit board in a generally horizontal plane, a portion of the circuit board extending out of and forwardly of said plug connector housing to define a mating blade portion of said plug connector, the plug connector being configured for latching engagement with a receptacle connector;

a delatching mechanism for delatching said plug connector from engagement with the receptacle connector, the delatching mechanism including an actuator, the actuator including a pair of arm members that extend at least partially lengthwise within said plug connector housing, the actuator being movable between first and second operative positions, each said actuator arm member including a free end that terminates in a delatching tab vertically spaced apart from said circuit board, the delatching tabs being configured to deflect an engagement member of said receptacle connector, said delatching mechanism further including bias elements extending transversely from said actuator arm members and configured to contact a portion of said connector housing when delatching said plug connector from the receptacle connector whereby, when said actuator is in said second operative position, the bias elements provide a biasing force on said actuator for returning said actuator to said first operative position; and, each of said bias elements terminate in a free end, said free ends being spaced apart from each other and aligned with a center longitudinal axis of said plug connector housing.

9. The plug connector of claim 8, wherein each of said actuator bias elements is enclosed within said plug connector housing and are vertically spaced apart from said circuit board.

10. The plug connector of claim 8, wherein said plug connector housing includes a reaction surface disposed in opposition to said bias elements, such that movement of said actuator to said second operative position creates a biasing force that biases said actuator toward said first operative position.

11. The plug connector of claim 10, wherein the plug connector housing reaction surface is disposed within said plug connector housing hollow interior.

12. The plug connector of claim 11, wherein said reaction surface is disposed on an upper interior surface of said plug connector housing hollow interior.

13. The plug connector of claim 8, wherein said plug connector housing includes a pair of openings disposed in a horizontal surface thereof, the openings being spaced vertically from said circuit board and communicating with said plug connector housing hollow interior, said delatching tabs being partially disposed within said openings.

14. The plug connector of claim 13, wherein each of said openings are T-shaped.

15. The plug connector of claim 8, wherein said delatching tabs each include a cam surface which is vertically spaced apart from said circuit board.

16. The plug connector of claim 15, wherein said actuator arm members have an S-shaped configuration.

17. The plug connector of claim 15, wherein said delatching tabs each include a cam block with an angled cam surface.

18. The plug connector of claim 8, wherein said actuator arm members are slidably disposed within said plug connector housing.

19. The plug connector of claim 8, wherein said two actuator arm members are interconnected together outside of said plug connector housing by a handle.

20. The plug connector of claim 19, wherein the handle includes an opening for grasping by a user.

21. The plug connector of claim 8, wherein said plug connector housing includes a wide body portion and a thin plug portion, said actuator arm members free ends being disposed within said thin plug portions and said bias elements being disposed within said wide body portion.

22. The plug connector of claim 8, wherein said delatching tabs are spaced apart from said actuator arm members.

23. The plug connector of claim 8, wherein said delatching mechanism includes a pair of elongated arms extending to the end of the delatching mechanism opposite the handle, and each said free end of the delatching tab is spaced internally away from said elongated arms of the delatching mechanism.

24. A plug connector comprising:

a connector housing, the connector housing including a wide body portions with a thin plug portion projecting from one end thereof, a hollow interior disposed within said wide body and plug portion, a circuit board being supported in a generally horizontal plane in the hollow interior of said connector housing when said plug connector is in a horizontal position, a portion of the circuit board extending out of said connector housing to define a mating blade portion of said plug connector, the plug connector being configured for latching engagement with a receptacle connector; and, a delatching mechanism for delatching said plug connector from engagement with the receptacle connector, the delatching mechanism including an actuator, the actuator including a backbone portion that interconnects a pair of spaced apart arm members, the arm members extending at least partially lengthwise within said wide body and plug portions of said connector housing, said actuator being movable between first and second operative positions, each of said arm members including a free end that is vertically spaced apart from said circuit board when said plug connector is in the horizontal position, the free ends being configured to deflect opposing engagement members of the receptacle connector, when said actuator is moved from said first operative position to said second operative position, said delatching mechanism further including a pair of biasing elements extending transversely from said arm members and configured to contact a portion of said connector housing when delatching said plug connector from the receptacle connector whereby, when said actuator is moved to said second operative position, the biasing elements exert a biasing force on said actuator for returning said actuator to said first operative position; and, each of said biasing elements terminates in a free end, said free ends being spaced apart from each other and aligned with a center longitudinal axis of said plug connector housing.

25. The plug connector of claim 24, wherein said delatching mechanism includes a pair of elongated arms extending to the end of the delatching mechanism opposite the handle, and each said free end of the delatching tab is spaced internally away from said elongated arms of the delatching mechanism.

* * * * *